US011850868B2

(12) United States Patent
Hozumi et al.

(10) Patent No.: US 11,850,868 B2
(45) Date of Patent: Dec. 26, 2023

(54) CIRCULATION DEVICE

(71) Applicant: KYOCERA CORPORATION, Kyoto (JP)

(72) Inventors: Daisuke Hozumi, Kirishima (JP); Hiroyuki Sugimoto, Kirishima (JP)

(73) Assignee: KYOCERA CORPORATION, Kyoto (JP)

( * ) Notice: Subject to any disclaimer, the term of this patent is extended or adjusted under 35 U.S.C. 154(b) by 1 day.

(21) Appl. No.: 17/638,781

(22) PCT Filed: Aug. 28, 2020

(86) PCT No.: PCT/JP2020/032714
§ 371 (c)(1),
(2) Date: Feb. 25, 2022

(87) PCT Pub. No.: WO2021/040005
PCT Pub. Date: Mar. 4, 2021

(65) Prior Publication Data

US 2022/0274420 A1 Sep. 1, 2022

(30) Foreign Application Priority Data

Aug. 30, 2019 (JP) ..... 2019-159115

(51) Int. Cl.
*B41J 2/175* (2006.01)
*B41J 2/18* (2006.01)

(52) U.S. Cl.
CPC ..... *B41J 2/17596* (2013.01); *B41J 2/18* (2013.01)

(58) Field of Classification Search
CPC ..... B41J 2/175; B41J 2/17563; B41J 29/02; B41J 2/17506; B41J 2/17509; B05B 13/0431; B05B 15/58; B05C 5/0216
See application file for complete search history.

(56) References Cited

U.S. PATENT DOCUMENTS 8,132,902 B2 * 3/2012 Shibata ..... B41J 2/17509 347/89
9,994,040 B2 * 6/2018 Karita ..... B41J 2/1707
11,358,387 B2 * 6/2022 Fukasawa ..... B41J 2/04586

FOREIGN PATENT DOCUMENTS

CN 106335278 A 1/2017
EP 3415240 A1 12/2018
JP 2008289983 A 12/2008

(Continued)

*Primary Examiner* — An H Do
(74) *Attorney, Agent, or Firm* — HAUPTMAN HAM, LLP

(57) ABSTRACT

A circulation device includes first and second valves, first and second pressure measuring portions, a detection unit, and a controller. The first valve controls the flow rate of a liquid from a storage to a droplet discharge unit. The second valve controls the flow rate of the liquid from the droplet discharge unit to the storage. The first pressure measuring portion measures the fluid pressure of the liquid flowing between the first valve and the droplet discharge unit as a supply pressure. The second pressure measuring portion measures the fluid pressure of the liquid flowing between the second valve and the droplet discharge unit as a recovery pressure. The detection unit detects information related to the droplet discharge unit. The controller controls the first and second valves in accordance with the information detected by the detection unit and adjusts the supply pressure and the recovery pressure.

10 Claims, 20 Drawing Sheets

(56) References Cited

FOREIGN PATENT DOCUMENTS

| | | | |
|---|---|---|---|
| JP | 2009160828 | A | 7/2009 |
| JP | 201296524 | A | 5/2012 |
| JP | 201718845 | A | 1/2017 |
| JP | 201756604 | A | 3/2017 |
| JP | 2018149482 | A | 9/2018 |

* cited by examiner

| CIRCULATION CONTROL MODE | CONTROL CONDITION |
|---|---|
| 1 | CONSTANT FLOW RATE |
| 2 | CONSTANT DIFFERENTIAL PRESSURE |

CIRCULATION DEVICE

RELATED APPLICATIONS

The present application is a National Phase of International Application Number PCT/JP2020/032714, filed Aug. 28, 2020, which claims priority to Japanese Application Number 2019-159115 filed Aug. 30, 2019.

TECHNICAL FIELD

The disclosed embodiments relate to a circulation device.

BACKGROUND ART

Inkjet printers and inkjet plotters that utilize an inkjet recording method are known as printing apparatuses. A liquid droplet discharge head for discharging liquid is mounted in printing apparatuses utilizing such an inkjet method.

Also, in inkjet printing apparatuses, various technologies for detecting operating abnormalities and controlling pressure in the liquid droplet discharge head have been proposed.

CITATION LIST

Patent Literature

Patent Document 1: JP 2017-56604 A
Patent Document 2: JP 2009-160828 A
Patent Document 3: JP 2012-96524 A
Patent Document 4: JP 2008-289983 A

SUMMARY

A circulation device according to an aspect of an embodiment includes: a storage unit that stores a liquid to be supplied to a liquid droplet discharge unit; a first channel communicating the storage unit and the liquid droplet discharge unit with each other to allow the liquid stored in the storage unit to flow into the liquid droplet discharge unit; and a second channel communicating the storage unit and the liquid droplet discharge unit with each other to allow the liquid that has flowed into the liquid droplet discharge unit to return to the storage unit. The circulation device controls the circulation pressure of the liquid circulating between the storage unit and the liquid droplet discharge unit. The circulation device includes a first valve portion, a second valve portion, a first pressure measuring portion, a second pressure measuring portion, a detection unit, and a controller. The first valve portion is interposed in the first channel and controls the flow rate of the liquid fed from the storage unit to the liquid droplet discharge unit. The second valve portion is interposed in the second channel and controls the flow rate of the liquid fed from the liquid droplet discharge unit to the storage unit. The first pressure measuring portion measures, through the first channel, the fluid pressure of the liquid flowing between the first valve portion and the liquid droplet discharge unit as a supply pressure. The second pressure measuring portion measures, through the second channel, the fluid pressure of the liquid flowing between the second valve portion and the liquid droplet discharge unit as a recovery pressure. The detection unit detects information related to the liquid droplet discharge unit. The controller controls the first valve portion and the second valve portion in accordance with the information detected by the detection unit and adjusts the supply pressure and the recovery pressure.

DESCRIPTION OF EMBODIMENTS

Embodiments of a circulation device disclosed in the present application will be described in detail below with reference to the accompanying drawings. Note that the invention according to the present application is not limited to the embodiments that will be described below.

In the following embodiments, a liquid droplet discharge system is described in which the circulation device disclosed in the present application is mounted on a freely operated robotic arm and the circulation device supplies liquid to a liquid droplet discharge head that discharges liquid in an inkjet method. The circulation device disclosed in the present application can be applied to inkjet printers and inkjet plotters that each utilize an inkjet recording method as well as devices that each discharge liquid droplets in an inkjet method.

Figure 1:
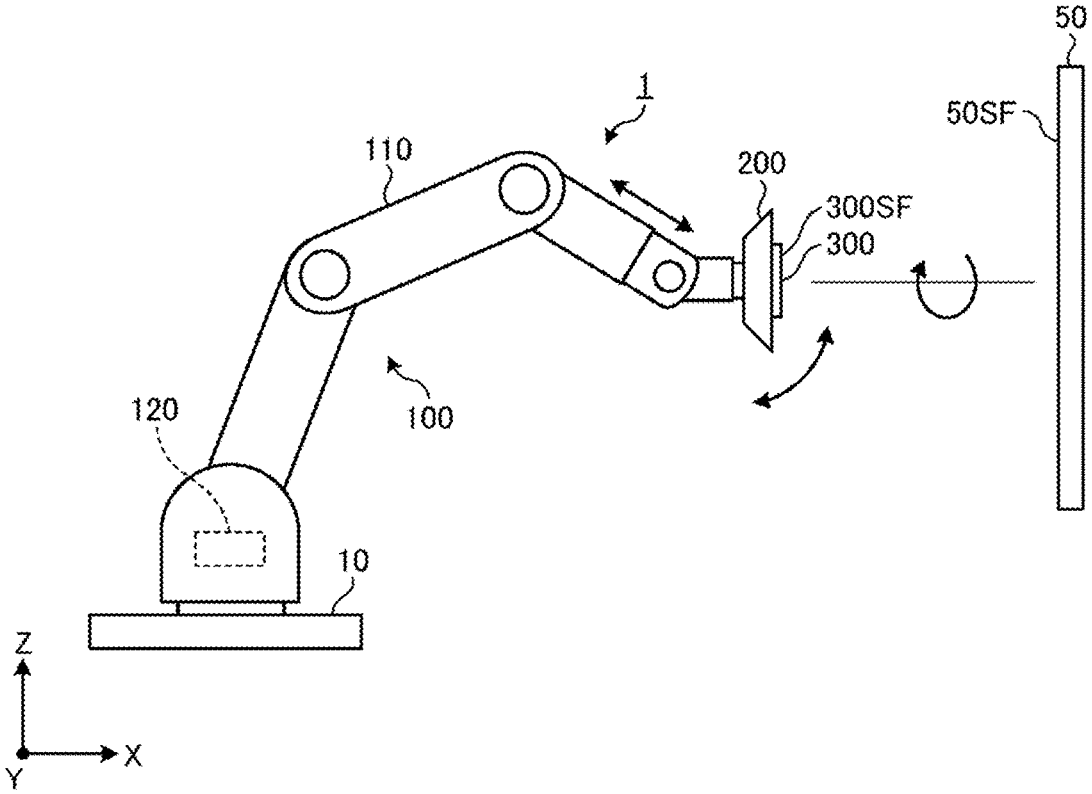
FIG. 1 is a diagram illustrating an example of an outer appearance configuration of a liquid droplet discharge system according to an embodiment.

Example of Outer Appearance Configuration of Liquid Droplet Discharge System An outer appearance configuration of an inkjet system according to an embodiment will be described using FIG. 1. FIG. 1 is a diagram illustrating an example of an outer appearance configuration of a liquid droplet discharge system according to an embodiment.

As illustrated in FIG. 1, a liquid droplet discharge system 1 includes a robotic arm 100, a circulation device 200, and a liquid droplet discharge head 300.

The robotic arm 100 is assembled on a base 10 mounted, for example, on a horizontal floor surface indoors or outdoors. The robotic arm 100 has an arm portion 110 and a control unit 120. The arm portion 110 is formed of a plurality of parts that are bent and stretched, and rotatably assembled. In accordance with a command from the control unit 120, the arm portion 110 can, for example, move the liquid droplet discharge head 300 mounted on a tip of the arm portion 110 and change the position, posture, and angle of the liquid droplet discharge head 300. The arm portion 110 illustrated in FIG. 1 is not particularly limited to the configuration illustrated in FIG. 1 as long as the arm portion 110 is provided with a degree of freedom with which the liquid droplet discharge head 300 can change the movement, position, posture, angle, and the like as necessary.

The control unit 120 is included, for example, in the arm portion 110. The control unit 120 controls the operation of the arm portion 110 by outputting a command to control the operation of the arm portion 110 to an actuator or the like that drives the arm portion 110. The control unit 120 is provided with a control device such as a processor and a storage device such as a memory. The storage device included in the control unit 120 stores data such as, for example, the procedure of operation by the liquid droplet discharge head 300, data such as the movement direction, position, posture, and angle during operation (liquid discharge), a control program for controlling the operation of the arm portion 110, and the like. The control device controls the operation of the arm portion 110 in accordance with a program and data stored in the storage device.

The robotic arm 100 can be moved in a vertical direction (z axis direction) by the arm portion 110, which, for example, moves the circulation device 200 and the liquid droplet discharge head 300 that are mounted on the tip of the arm portion 110 along a predetermined axis of rotation. This allows the circulation device 200 and the liquid droplet discharge head 300 to, for example, assume a posture in which, as illustrated in FIG. 1, a liquid discharge surface 30SF of the liquid droplet discharge head 300 faces parallel to a spraying surface 50SF of an object 50. Furthermore, the robotic arm 100 can, for example, rotate by the arm portion 110 about a predetermined rotation axis the circulation device 200 and the liquid droplet discharge head 300, which are assembled on the tip of the arm portion 110. This allows the circulation device 200 and the liquid droplet discharge head 300 to, for example, switch a position in a longitudinal direction and a position in a lateral direction, or to invert an upper position and a lower position.

The circulation device 200 is installed at a tip portion of the arm portion 110 of the robotic arm 100. The circulation device 200 supplies a liquid to the liquid droplet discharge head 300 while controlling the circulation pressure of the liquid circulating between the circulation device 200 and the liquid droplet discharge head 300. The liquid droplet discharge head 300 is assembled on the circulation device 200 installed at the tip portion of the arm portion 110 of the robotic arm 100. The liquid droplet discharge head 300 functions as a liquid droplet discharge unit that discharges the liquid to the object 50.

Meanwhile, the circulation pressure of the liquid supplied to the liquid droplet discharge head 300 is affected by the movement of the liquid droplet discharge head 300 by the robotic arm 100, and a change in the position, posture, and angle, and the like of the liquid droplet discharge head 300. In view of this, the present application proposes the circulation device 200 that can keep the circulation pressure of the liquid appropriate for the liquid droplet discharge head 300.

Configuration Example of Liquid Droplet Discharge Head

Figure 2:
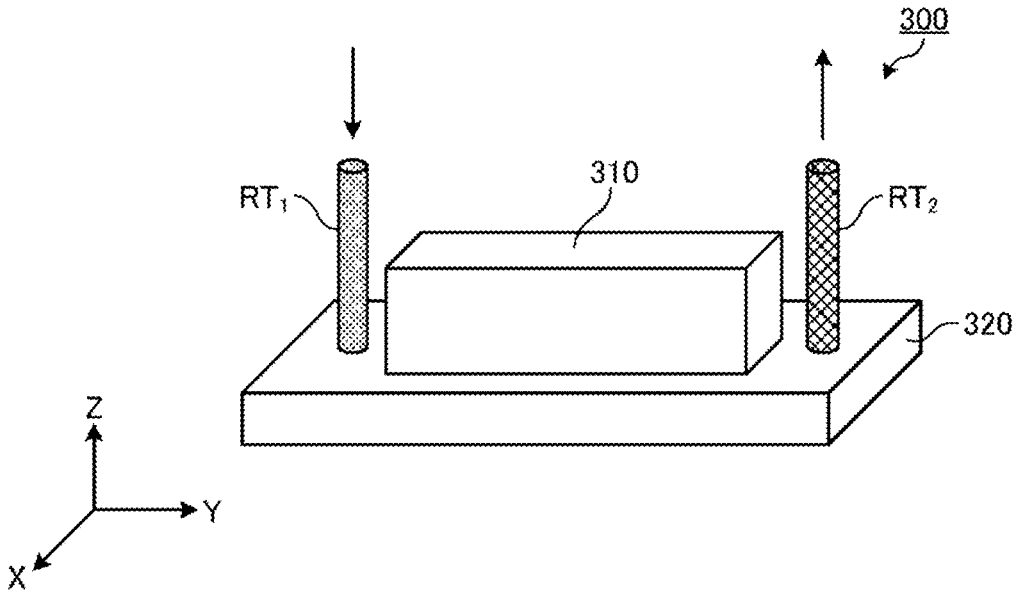
FIG. 2 is a perspective view schematically illustrating an outer appearance configuration of a liquid droplet discharge head according to an embodiment.
Figure 3:
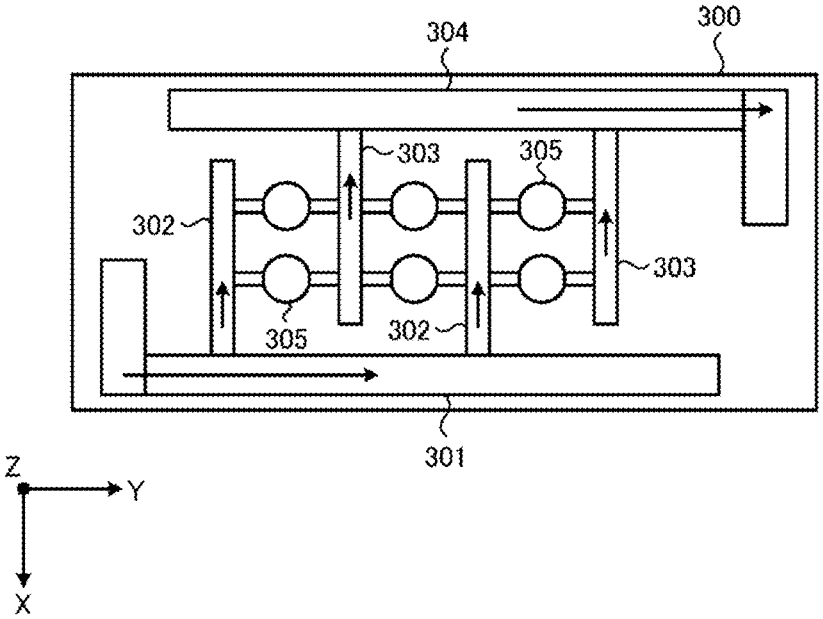
FIG. 3 is a flat surface view illustrating a liquid droplet discharge head according to an embodiment.
Figure 4:
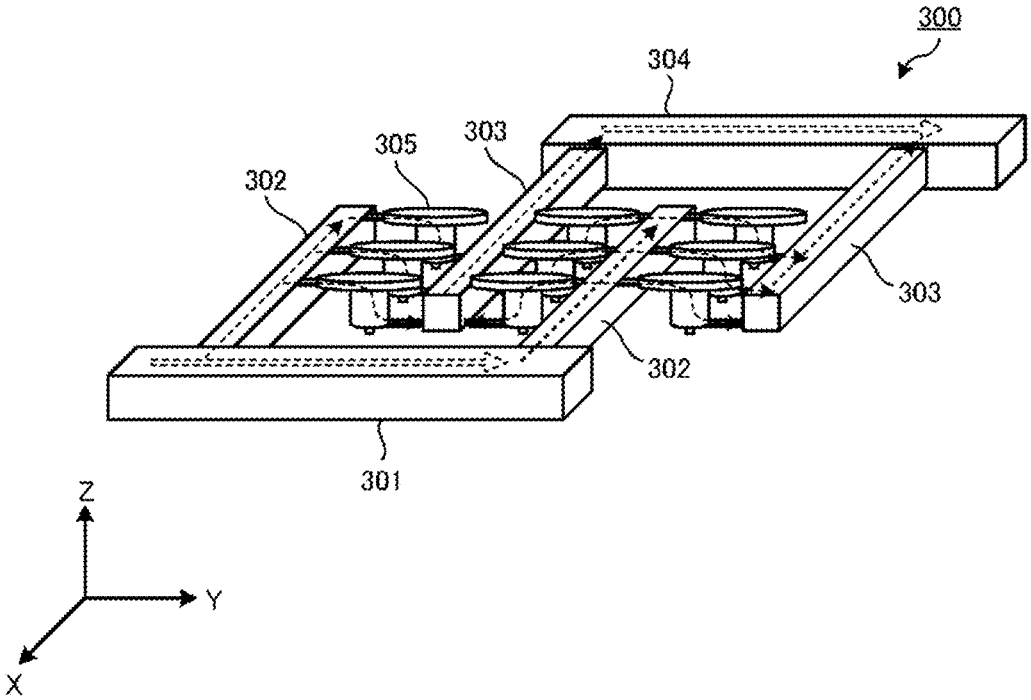
FIG. 4 is a diagram schematically illustrating channels inside a liquid droplet discharge head according to an embodiment.

The liquid droplet discharge head 300 according to an embodiment will be described with reference to FIGS. 2 to 4. FIG. 2 is a perspective view schematically illustrating an outer appearance configuration of a liquid droplet discharge head according to an embodiment. FIG. 3 is a flat surface view of the liquid droplet discharge head according to an embodiment. FIG. 4 is a diagram schematically illustrating channels inside a liquid droplet discharge head according to an embodiment.

As illustrated in FIG. 2, the liquid droplet discharge head 300 includes a housing including a box-shaped member 310 and a substantially plate-shaped member 320. The housing of the liquid droplet discharge head 300 includes a first channel $RT_1$ for supplying liquid from the circulation device 200 into the head and a second channel $RT_2$ for feeding the liquid recovered inside the head back to the circulation device 200.

As illustrated in FIG. 3, the liquid droplet discharge head 300 includes a supply reservoir 301, a supply manifold 302, a recovery manifold 303, a recovery reservoir 304, and an element 305.

The supply reservoir 301 has an elongated shape extending in a longitudinal direction (Y axis direction) of the liquid droplet discharge head 300 and connects to the supply manifold 302. The supply reservoir 301 has a channel therein. As illustrated in FIG. 4, liquid supplied through the first channel $RT_1$ to the supply reservoir 301 and stored in the channel of the supply reservoir 301 is fed into the supply manifold 302.

The supply manifold 302 has an elongated shape extending in a lateral direction (X axis direction) of the liquid droplet discharge head 300 to before the recovery reservoir 304. The supply manifold 302 has a channel therein that communicates with the channel included in the supply reservoir 301 and with the element 305. As illustrated in FIG. 4, the liquid fed from the supply reservoir 301 to the supply manifold 302 is fed from the supply manifold 302 to the element 305.

The recovery manifold 303 has an elongated shape extending in the lateral direction (X axis direction) of the liquid droplet discharge head 300 to before the supply reservoir 301. The recovery manifold 303 has a channel therein that communicates with the channel included in the recovery reservoir 304 and the element 305. As illustrated in FIG. 4, liquid that has not been discharged from the element 305 to the outside is fed into the recovery manifold 303.

The recovery reservoir 304 has an elongated shape extending in the longitudinal direction (Y axis direction) of the liquid droplet discharge head 300 and connects to the recovery manifold 303. The recovery reservoir 304 has a channel therein. As illustrated in FIG. 4, the liquid fed from the recovery manifold 303 to the recovery reservoir 304 and stored in the channel of the recovery reservoir 304 is fed back to the tank 201 through the second channel $RT_2$.

The element 305 has a discharge hole. The element 305, for example, sucks liquid from the supply manifold 302 by negative pressure generated in a pressure chamber (not illustrated) and discharges the liquid thus sucked from the discharge hole toward the object 50 by positive pressure generated in the pressure chamber (not illustrated).

Configuration Example of Circulation Device

Figure 5:
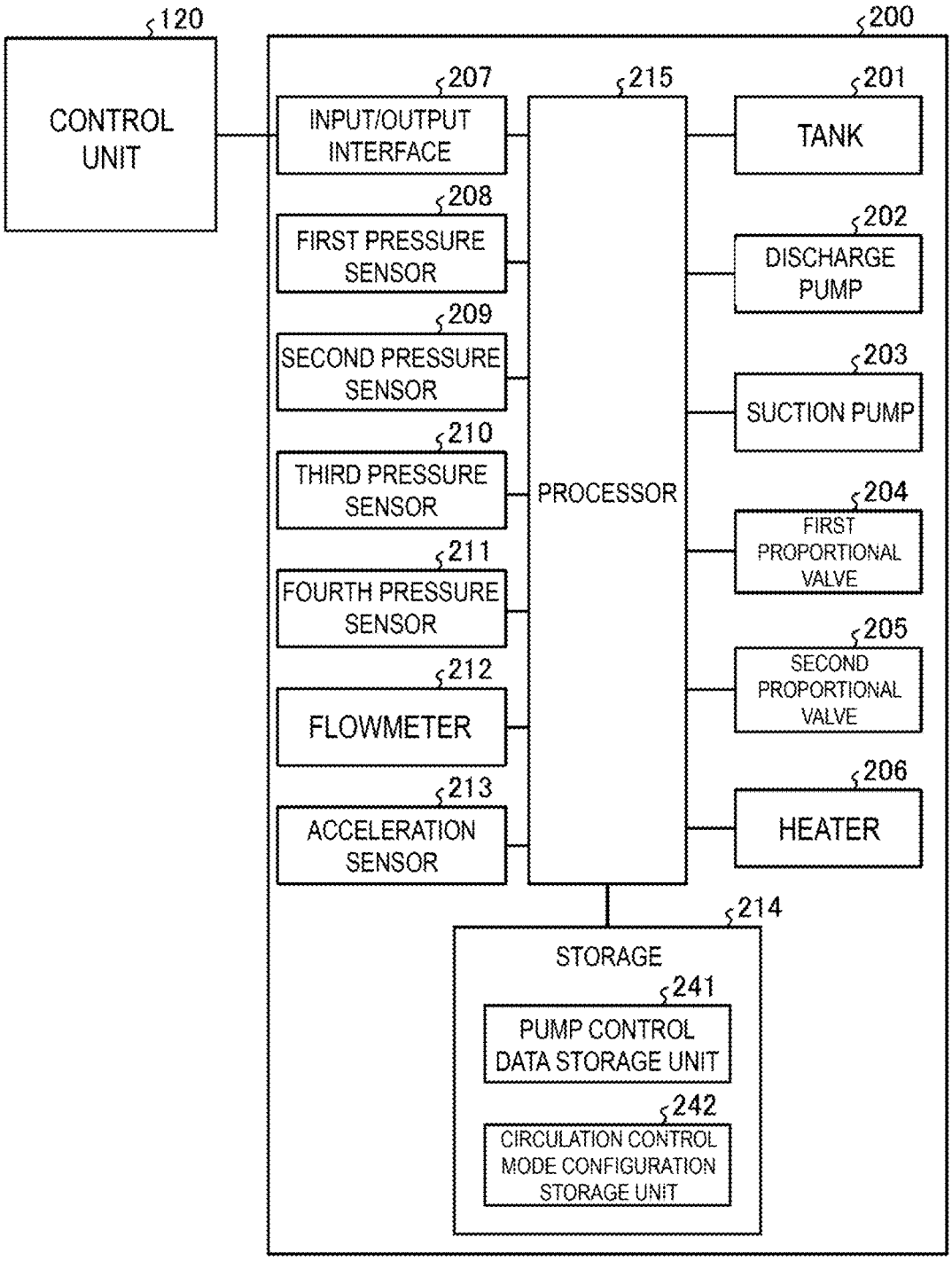
FIG. 5 is a block diagram illustrating an example of a functional configuration of a circulation device according to an embodiment.
Figure 6:
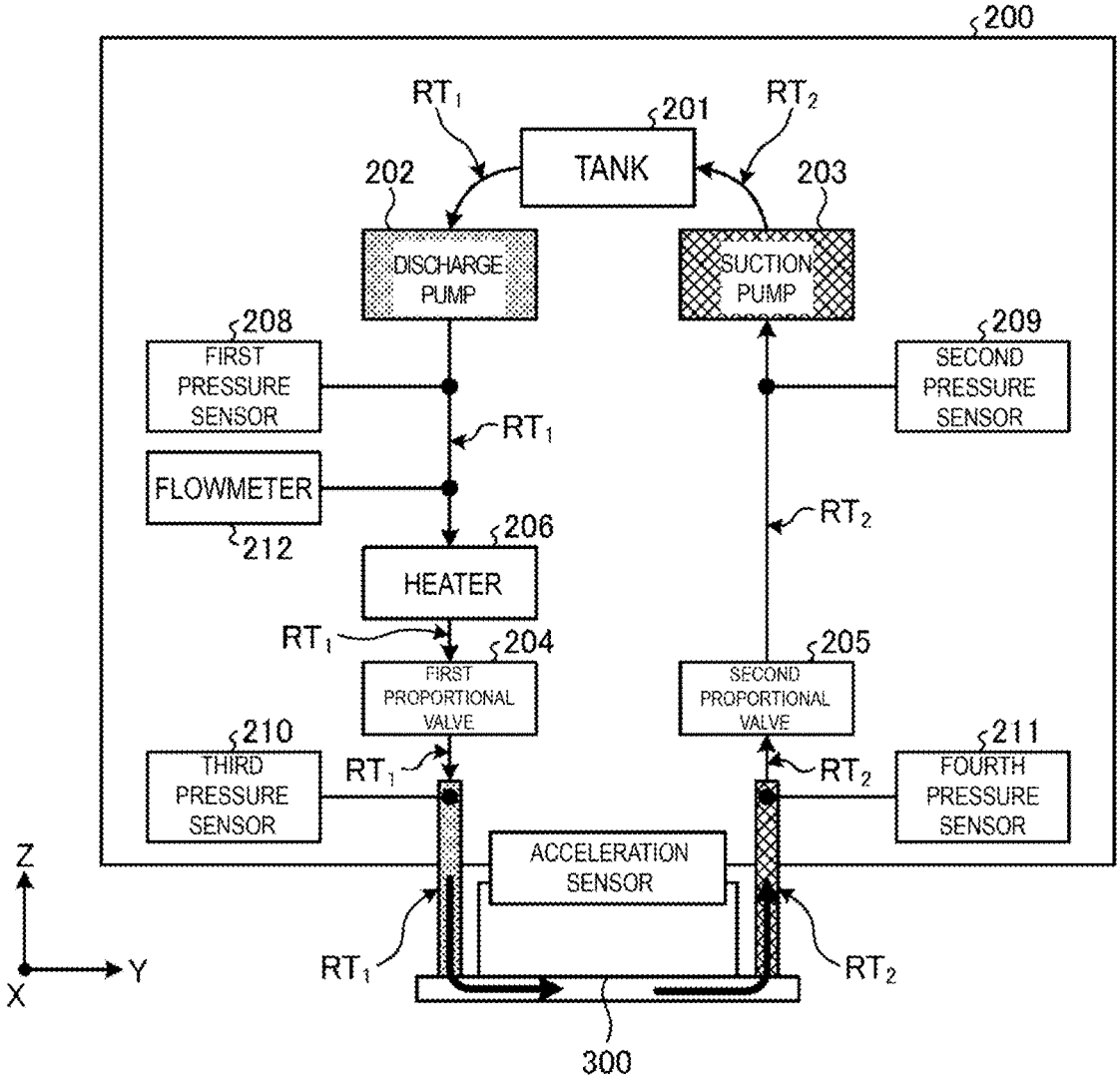
FIG. 6 is a diagram schematically illustrating a circulation mechanism of a circulation device according to an embodiment.

Next, a configuration example of the circulation device 200 according to an embodiment will be described. FIG. 5 is a block diagram illustrating an example of a functional configuration of a circulation device according to an embodiment. FIG. 6 is a diagram schematically illustrating a circulation mechanism of a circulation device according to an embodiment.

Note that FIG. 5 illustrates an example of a functional configuration of the circulation device 200 according to an embodiment, and the functional configuration of the circulation device 200 should not be particularly limited to the example illustrated in FIG. 5, provided that the functions of the circulation device 200 according to the embodiment can be realized. In addition, FIG. 5 illustrates, in functional blocks, components provided in the circulation device 200 according to the embodiment and omits a description of other components in general. Moreover, the components of the circulation device 200 illustrated in FIG. 5 are functional concepts and are not limited to the example illustrated in FIG. 5, and are not necessarily physically configured as illustrated. For example, the specific form of distribution and integration of each of the functional blocks is not limited to that illustrated, and all or a portion thereof can be functionally or physically distributed and integrated in any unit, depending on various loads, usage conditions, and the like.

As illustrated in FIG. 5, the circulation device 200 includes a tank 201, a discharge pump 202, a suction pump 203, a first proportional valve 204, a second proportional valve 205, and a heater 206. The circulation device 200 also includes an input/output interface 207, a first pressure sensor 208, a second pressure sensor 209, a third pressure sensor 210, a fourth pressure sensor 211, a flowmeter 212, and an acceleration sensor 213. The circulation device 200 further includes a storage 214 and a processor 215.

As illustrated in FIG. 6, the circulation device 200 includes the first channel $RT_1$ and the second channel $RT_2$. The first channel $RT_1$ is a channel communicating the tank 201 and the liquid droplet discharge head 300 with each other to allow the liquid stored in the tank 201 to flow into the liquid droplet discharge head 300. The second channel $RT_2$ is a channel communicating the tank 201 and the liquid droplet discharge head 300 with each other to allow the liquid that has flowed into the liquid droplet discharge head 300 to return to the tank 201. The liquid recovered in the liquid droplet discharge head 300 through the second channel $RT_2$ without being discharged from the liquid droplet discharge head 300 to the outside is sent back to the tank 201. The first channel $RT_1$ and the second channel $RT_2$ can be implemented, for example, by a pipe formed of a predetermined material that does not interact with constituents of the liquid. As illustrated in FIG. 6, for example, the circulation device 200 having such components controls the circulation pressure of the liquid circulating clockwise between the tank 201 and the liquid droplet discharge head 300.

The tank 201 stores the liquid supplied to the liquid droplet discharge head 300. The tank 201 functions as a storage unit for storing the liquid supplied to the liquid droplet discharge head 300.

The discharge pump 202 feeds the liquid stored in the tank 201 through the first channel $RT_1$ to the liquid droplet discharge head 300. The discharge pump 202 generates positive pressure for feeding the liquid stored in the tank 201 to the liquid droplet discharge head 300. The discharge pump 202 can, for example, feed the liquid stored in the tank 201 to the liquid droplet discharge head 300 at a predetermined constant supply pressure.

The suction pump 203 feeds, through the second channel $RT_2$, the liquid recovered in the liquid droplet discharge head 300 to the tank 201. The suction pump 203 sucks the liquid recovered in the liquid droplet discharge head 300 to generate negative pressure to be sent back to the tank 201. The suction pump 203 can, for example, feed the liquid sucked from the liquid droplet discharge head 300 to the tank 201 at a predetermined constant recovery pressure.

The discharge pump 202 and the suction pump 203 can be implemented by a rotary pump such as a gear pump or a positive displacement pump such as a diaphragm pump.

The first proportional valve 204 functions as a first valve portion interposed in the first channel $RT_1$ between the tank 201 and the liquid droplet discharge head 300 to proportionally control the flow rate of the liquid supplied to the liquid droplet discharge head 300. The first proportional valve 204 can continuously modify the channel cross-sectional area for the liquid between 0 to 100%, and controls the flow rate of the liquid to a desired flow rate. For example, the first proportional valve 204 can reduce the supply pressure when supplying liquid to the liquid droplet discharge head 300 by reducing the channel cross-sectional area for the liquid. On the other hand, the first proportional valve 204 can increase the supply pressure when supplying liquid to the liquid droplet discharge head 300 by increasing the channel cross-sectional area for the liquid.

The second proportional valve 205 functions as a second valve portion interposed in the second channel $RT_2$ between the tank 201 and the liquid droplet discharge head 300 to proportionally control the flow rate of the liquid fed from the liquid droplet discharge head 300 to the tank 201. The second proportional valve 205, as with the first proportional valve 204, can continuously modify the channel cross-sectional area for the liquid between 0 to 100%, and controls the flow rate of the liquid to a desired flow rate. For example, the second proportional valve 205 can reduce the recovery pressure when recovering liquid from the liquid droplet discharge head 300 by reducing the channel cross-sectional area for the liquid. On the other hand, the second proportional valve 205 can increase the recovery pressure when recovering the liquid from the liquid droplet discharge head 300 by increasing the channel cross-sectional area for the liquid.

The first proportional valve 204 and the second proportional valve 205 can be implemented by a proportional selector valve of an electromagnetic type or a proportional selector valve of a pneumatic type.

The heater 206 is provided in the first channel $RT_1$ or adjacent to the first channel $RT_1$, and heats the liquid flowing through the first channel $RT_1$.

The input/output interface 207 exchanges various types of information with the control unit 120 of the robotic arm 100. The input/output interface 207 can, for example, receive a signal indicating the start of the discharge of liquid from the control unit 120 and a signal indicating the end of the discharge of the liquid.

The first pressure sensor 208 measures, by the discharge pump 202, the pressure of the liquid fed from the tank 201 to the liquid droplet discharge head 300. The first pressure sensor 208 measures the fluid pressure downstream of the discharge pump 202 in a circulation direction of the liquid in the circulation device 200. The first pressure sensor 208 sends the measurement results to the processor 215.

The second pressure sensor 209 measures the pressure of the liquid that is sucked from the liquid droplet discharge head 300 by the suction pump 203 and fed to the tank 201. The second pressure sensor 209 measures the fluid pressure upstream of the suction pump 203 in the circulation direction of the liquid in the circulation device 200. The second pressure sensor 209 sends the measurement results to the processor 215.

Figures 7, 8:
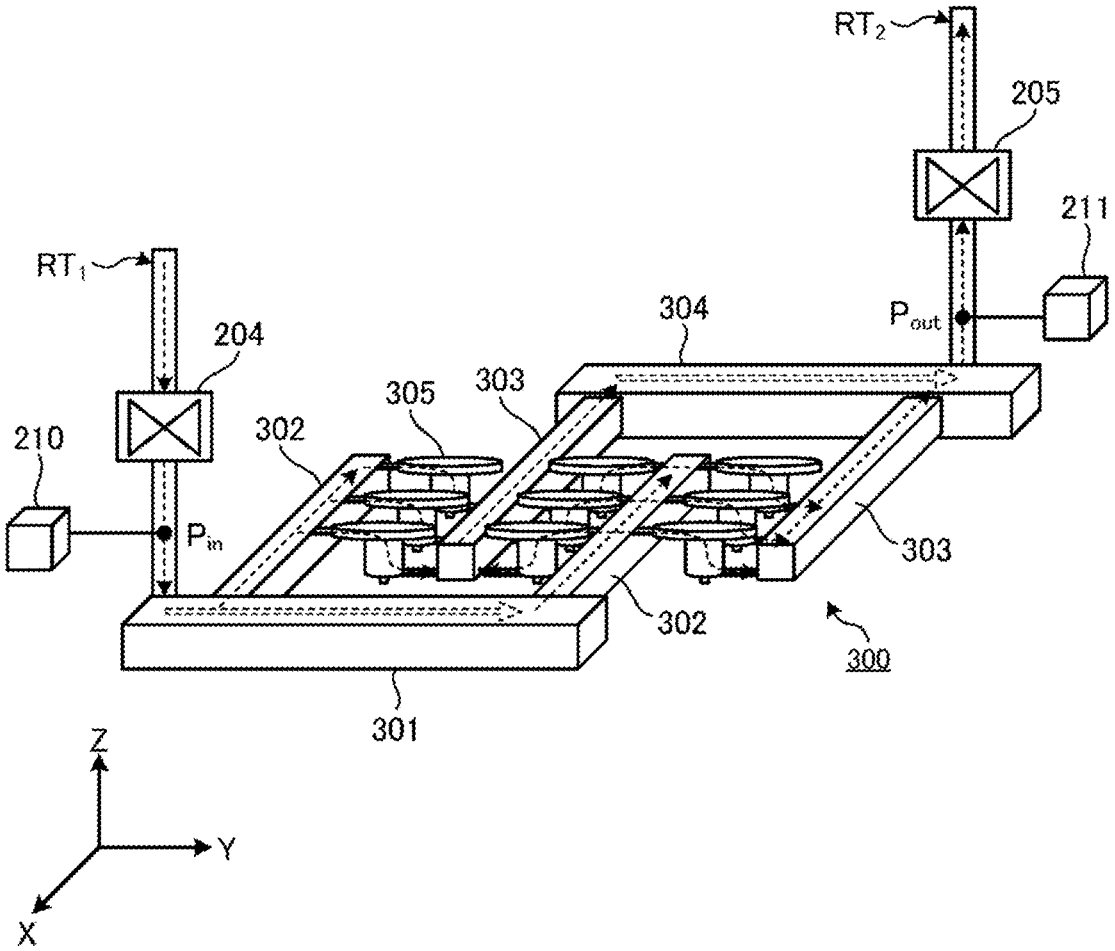
FIG. 7 is a diagram schematically illustrating a positional relationship between a third pressure sensor and a fourth pressure sensor according to an embodiment.
FIG. 8 is a diagram illustrating an overview of configuration information of circulation control modes according to an embodiment.

The third pressure sensor 210 functions as a first pressure measuring portion that measures, through the first channel $RT_1$, the fluid pressure of the liquid flowing between the first proportional valve 204 and the liquid droplet discharge head 300 as the supply pressure. The third pressure sensor 210 sends the measurement results to the processor 215. The fourth pressure sensor 211 functions as a second pressure measuring portion that measures, through the second channel $RT_2$, the fluid pressure of the liquid flowing between the second proportional valve 205 and the liquid droplet discharge head 300 as the recovery pressure. The fourth pressure sensor 211 sends the measurement results to the processor 215. FIG. 7 is a diagram schematically illustrating the positional relationship between the third pressure sensor and the fourth pressure sensor according to an embodiment.

As illustrated in FIG. 7, the third pressure sensor 210 measures the fluid pressure of the liquid immediately before the liquid flows into the liquid droplet discharge head 300 after passing through the first proportional valve 204. That is, the third pressure sensor 210 measures the fluid pressure downstream of the first proportional valve 204 in the circulation direction of the liquid in the circulation device 200 as a supply pressure "$P_{in}$". Also, as illustrated in FIG. 7, the fourth pressure sensor 211 measures the fluid pressure of the liquid immediately after being fed from the liquid droplet discharge head 300 toward the tank 201 and before passing through the second proportional valve 205. That is, the fourth pressure sensor 211 measures the pressure upstream of the second proportional valve 205 in the circulation direction of the liquid in the circulation device 200 as a recovery pressure "$P_{out}$".

The flowmeter 212 measures the flow rate of the liquid supplied to the liquid droplet discharge head 300. The flowmeter 212 sends the measurement results to the processor 215.

The acceleration sensor 213 measures an acceleration acting on the liquid droplet discharge head 300. The acceleration sensor 213 functions as a detection unit for detecting information related to the liquid droplet discharge head 300. The acceleration sensor 213 sends the measurement results to the processor 215. Note that the circulation device 200 may include a sensor other than the acceleration sensor 213 as long as it is a sensor capable of detecting a change in the movement of the liquid droplet discharge head 300, the position, posture, and angle of the liquid droplet discharge head 300, and the like.

The storage 214 stores programs and data necessary for various processes of the circulation device 200. The storage 214 includes, for example, a pump control data storage unit 241 and a circulation control mode configuration storage unit 242.

The pump control data storage unit 241 stores data for pump control that is set in advance. The data for pump control includes, for example, a target value of pressure (positive pressure) applied to the liquid that the discharge pump 202 feeds, data on pressure (negative pressure) applied to the liquid that the suction pump 203 sucks, and the like. When considering the discharge of the liquid from the liquid droplet discharge head 300, the target value of the positive pressure of the discharge pump 202 is preset to, for example, a value approximately 1.2 to 3 times higher than the pressure at which the liquid is supplied to the liquid droplet discharge head 300. In contrast, the target value for the negative pressure of the suction pump 203 is preset to a value approximately 1.2 to 3 times lower than the pressure at which the liquid is supplied to the liquid droplet discharge head 300.

The circulation control mode configuration storage unit 242 stores configuration information of circulation control modes for controlling the circulation pressure between the tank 201 and the liquid droplet discharge head 300. FIG. 8 is a diagram illustrating an overview of configuration information of circulation control modes according to an embodiment.

As illustrated in FIG. 8, the configuration information of the circulation control modes stored in the circulation control mode configuration storage unit 242 includes items of the circulation control modes and items of control conditions, and these sets of items are associated with each other. A mode number indicating the circulation control mode is stored in an item of the circulation control mode. Furthermore, the control condition is stored in the control target item. The circulation control modes are used depending on the purpose of use of the liquid discharged from the liquid droplet discharge head 300, the physical properties of the liquid, and the like.

When the circulation control mode is mode 1, the control condition of "constant flow rate" is associated therewith. Here, the flow rate indicates the flow rate of the liquid supplied from the tank 201 through the first proportional valve 204 to the liquid droplet discharge head 300. A change in the posture and the like of the liquid droplet discharge head 300 may cause a hydraulic head pressure to act on the liquid circulating inside the head, changing the circulating flow rate of the liquid circulating inside the head, and a shortage in the supply of liquid to the head may occur. Thus, the mode 1 is used as the circulation control mode to keep constant the circulation flow rate of the liquid circulating inside the head, to compensate for insufficient supply of liquid to the head, and to discharge liquid in a stable manner.

Furthermore, when the circulation control mode is mode 2, the control condition of "constant differential pressure" is associated therewith. Here, the differential pressure indicates a difference in pressure between the fluid pressure, measured as a supply pressure, of the liquid flowing between the first proportional valve 204 and the liquid droplet discharge head 300, and the fluid pressure, measured as a recovery pressure, of the liquid flowing between the second proportional valve 205 and the liquid droplet discharge head 300. The supply pressure can be obtained from the measurement results by the third pressure sensor 210. The recovery pressure can be obtained from the measurement results obtained by the fourth pressure sensor 211. Due to a change in the posture and the like of the liquid droplet discharge head 300, a pressure distribution may occur in the head surface due to hydraulic head pressure, the meniscus may not be appropriately held, discharge holes from which too much liquid is discharged and discharge holes into which liquid is drawn may be generated, and the discharge of liquid may become unstable. Thus, the mode 2 may be used as the circulation control mode to reduce the pressure distribution in the surface of the liquid droplet discharge head 300 and to maintain the retention performance of the meniscus.

The processor 215 executes various processes in the circulation device 200 in accordance with programs, data, and the like that are stored in the storage 214. The processor 215 implements various functions for controlling the components of the circulation device 200 by reading out and executing the computer program stored in the storage 214.

Control of Pump

The processor 215 makes an adjustment to keep constant the positive pressure applied to the liquid that the discharge pump 202 feeds in accordance with the measurement results of the first pressure sensor 208 and the measurement results of the third pressure sensor 210. For example, the processor 215 adjusts the positive pressure of the discharge pump 202 such that the pressure of the liquid obtained from the measurement results of the first pressure sensor 208 remains approximately 1.2 to 3 times larger than the pressure of the liquid obtained from the measurement results of the third pressure sensor 210.

The processor 215 also makes an adjustment to keep constant the negative pressure applied to the liquid that the suction pump 203 sucks in accordance with the measurement results of the second pressure sensor 209 and the third pressure sensor 210. For example, the processor 215 adjusts the negative pressure of the suction pump 203 such that the pressure of the liquid obtained from the measurement results of the second pressure sensor 209 remains approximately 1.2 to 3 times lower than the pressure of the liquid obtained from the measurement results of the third pressure sensor 210.

The processor 215 circulates the liquid between the tank 201 and the liquid droplet discharge head 300 by making an adjustment to keep constant the differential pressure between the positive pressure that the discharge pump 202 applies to the liquid and the negative pressure that the suction pump 203 applies to the liquid.

Control of Proportional Valve

The processor 215 controls the first proportional valve 204 and the second proportional valve 205 in accordance with the acceleration detected by the acceleration sensor 213 to adjust the supply pressure and the recovery pressure. A method of controlling the first proportional valve 204 and the second proportional valve 205 will be described below using FIGS. 9 to 20. FIGS. 9, 12, 15, and 18 are each a diagram schematically illustrating an example of a posture of a liquid droplet discharge head according to an embodiment. FIGS. 10, 13, 16, and 19 are each a diagram schematically illustrating a positional relationship of pressure sensors according to an embodiment. FIGS. 11, 14, 17, and 20 are each a diagram schematically illustrating a positional relationship of discharge holes according to an embodiment.

With reference to FIGS. 9 to 14, a description will be provided for control in a case where an upstream side of the liquid flowing through a manifold or reservoir is located on a lower side with respect to the circulation direction of the liquid.

Figure 9:
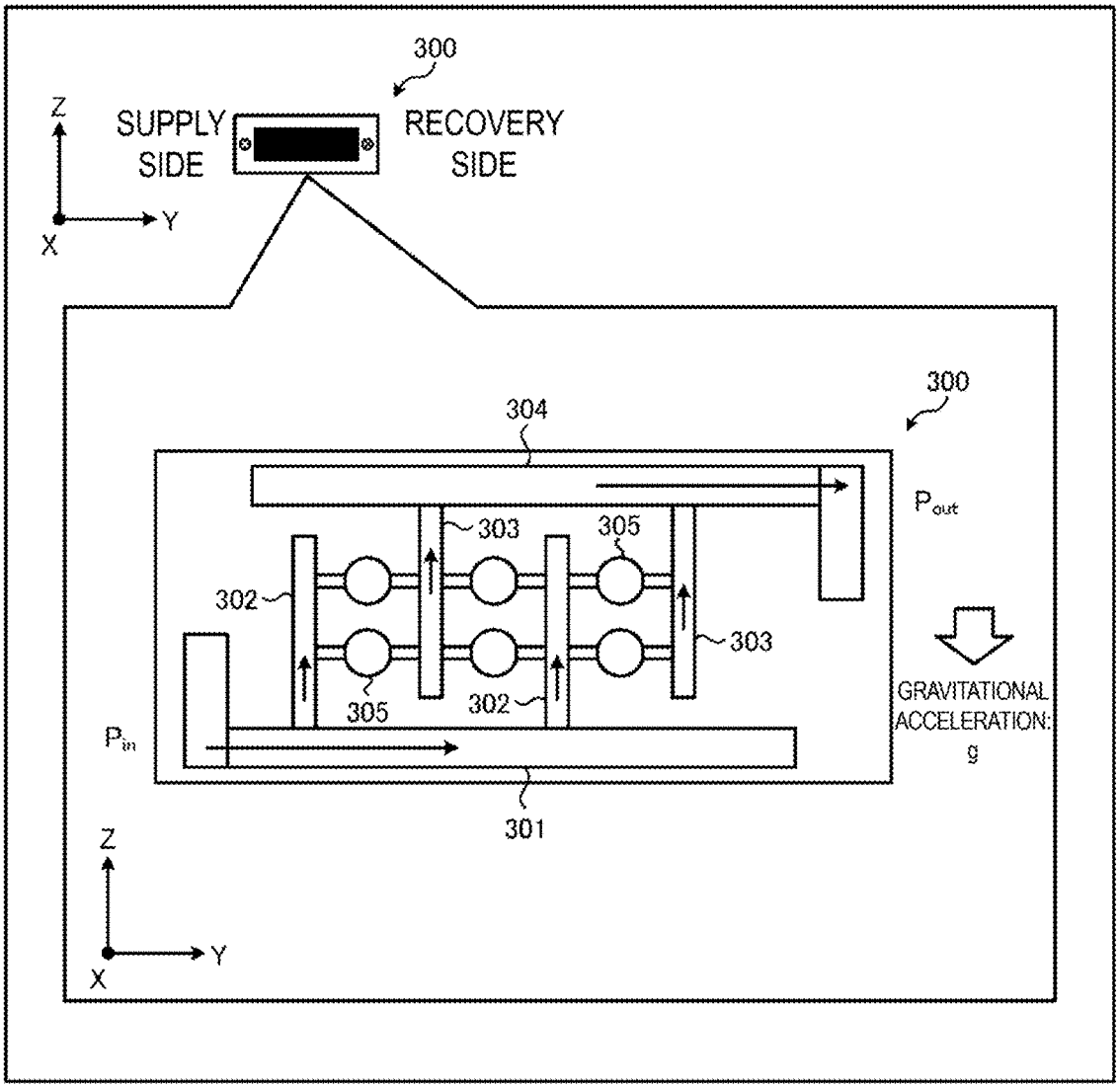
FIG. 9 is a diagram schematically illustrating an example of a posture of a liquid droplet discharge head according to an embodiment.

The liquid droplet discharge head 300 illustrated in FIG. 9 assumes a posture in which the liquid discharge surface 300SF faces parallel to the object 50 with a liquid supply side facing the left side and a liquid recovery side facing the right side (see FIG. 1). Here, for example, as illustrated in FIG. 9, an upstream side of the liquid flowing through the supply manifold 302 and the recovery manifold 303 is located on a lower side of the circulation direction of the liquid. On the other hand, a downstream side of the liquid flowing through the supply manifold 302 and the recovery manifold 303 is located on an upper side of the circulation direction of the liquid. Thus, in a case where the liquid droplet discharge head 300 assumes the posture illustrated in FIG. 9, the effect of the hydraulic head pressure is expected to increase the pressure on the upstream side of the liquid flowing through the supply manifold 302 and the recovery manifold 303, and to decrease the pressure on the downstream side thereof. Then, the circulating flow rate of the liquid circulating inside the head is expected to change due to the hydraulic head pressure acting on the liquid circulating inside the head.

Thus, the processor 215 calculates, in accordance with the acceleration measured by the acceleration sensor 213, an estimate of the hydraulic head pressure that is expected to be acting on the liquid circulating through the liquid droplet discharge head 300. The processor 215 calculates an estimate of the hydraulic head pressure, according to Equation (1) below. In Equation (1) below, "ρ" denotes the density of the liquid; "a" denotes the acceleration acting on the liquid; and "h" denotes the difference between the height of the third pressure sensor 210 and the height of the fourth pressure sensor 211 in a direction in which the acceleration acts.

$$\text{Estimate of hydraulic head pressure} = \rho a h \quad (1)$$

Figure 10:
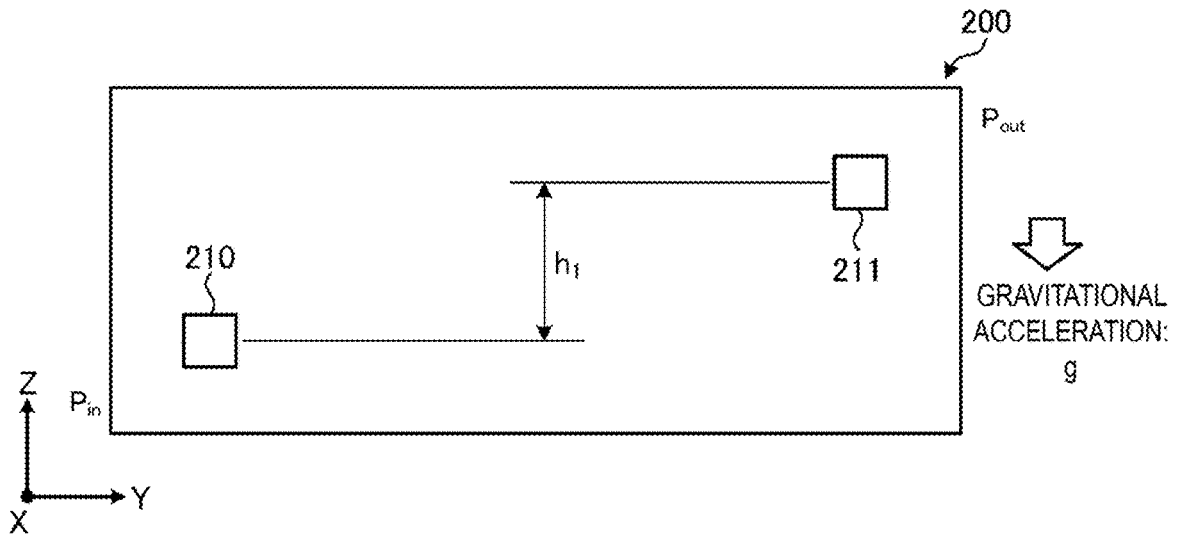
FIG. 10 is a diagram schematically illustrating a positional relationship of pressure sensors according to an embodiment.

Furthermore, a value measured by the acceleration sensor 213 is used as the acceleration "a" used in calculating an estimate of the hydraulic head pressure according to Equation (1) above. Only a gravitational acceleration "g" acts on the liquid droplet discharge head 300 stopped in the posture illustrated in FIG. 9. Thus, the acceleration sensor 213 detects only the gravitational acceleration "g". Thus, the gravitational acceleration "g" is used as the acceleration "a" used in Equation (1) above. Furthermore, in a case where the circulation control mode is the mode 1, a height "$h_1$" shown in FIG. 10 is used as the height "h" in Equation (1) above. As shown in FIG. 10, the height "$h_1$" corresponds to the difference in height between the installation position of the third pressure sensor 210 and the installation position of the fourth pressure sensor 211 in a direction of the gravitational acceleration "g" acting on both the third pressure sensor 210 and the fourth pressure sensor 211. The height "$h_1$" is calculated in accordance with the installation positions, based on the design of the liquid droplet discharge head 300, of the third pressure sensor 210 and the fourth pressure sensor 211, and the posture, based on the detection results of the acceleration sensor 213, of the liquid droplet discharge head 300, and the like. The processor 15 calculates an estimate of the hydraulic head pressure by regarding the physical difference in height between the installation position of the third pressure sensor 210 and the installation position of the fourth pressure sensor 211 as the height of the water column of the liquid, the physical difference in height being due to a change in the movement and the posture of the liquid droplet discharge head 300.

The processor 215 checks the configuration information of the circulation control modes stored in the circulation control mode configuration storage unit 242, and adjusts the supply pressure and the recovery pressure using Equation (2) below. In Equation (2) below, "ΔP" denotes the differential pressure, which is the difference between the supply pressure and the recovery pressure; "$P_{in}$" denotes the supply pressure; "$P_{out}$" denotes the recovery pressure; "R" denotes the fluid resistance of the liquid; and "U" denotes the flow rate.

$$\Delta P = P_{in} - P_{out} = R \times U + \rho a h \quad (2)$$

When the circulation control mode is set to the mode 1, the processor 215 adjusts the supply pressure "$P_{in}$" and the recovery pressure "$P_{out}$" so as to satisfy the control condition of "constant flow rate". In the example illustrated in FIG. 9, the effect of the hydraulic head pressure is expected to cause the pressure on the upstream side of the liquid flowing through the supply manifold 302 and the recovery manifold 303 to increase, and to cause the pressure on the downstream side thereof to decrease. To meet the control condition of "constant flow rate", the supply pressure "$P_{in}$" is to be increased and the recovery pressure "$P_{out}$" is to be decreased so as to counteract the effect of the hydraulic head pressure. The processor 215 uses Equation (2) above to calculate an adjustment amount of each of the supply pressure "$P_{in}$" and the recovery pressure "$P_{out}$" that satisfies the control condition of "constant flow rate". The processor 215, while referring to the measurement results of the third pressure sensor 210, increases the flow rate of the liquid passing through the first proportional valve 204 by widening the channel cross-sectional area of the first proportional valve 204 to increase the supply pressure "$P_{in}$" to a desired pressure based on the adjustment amount. On the other hand, the processor 215, while referring to the measurement results of the fourth pressure sensor 211, decreases the flow rate of the liquid passing through the second proportional valve 205 by narrowing the channel cross-sectional area of the second proportional valve 205 to decrease the recovery pressure "$P_{out}$" to a desired pressure based on the adjustment amount.

Figure 11:
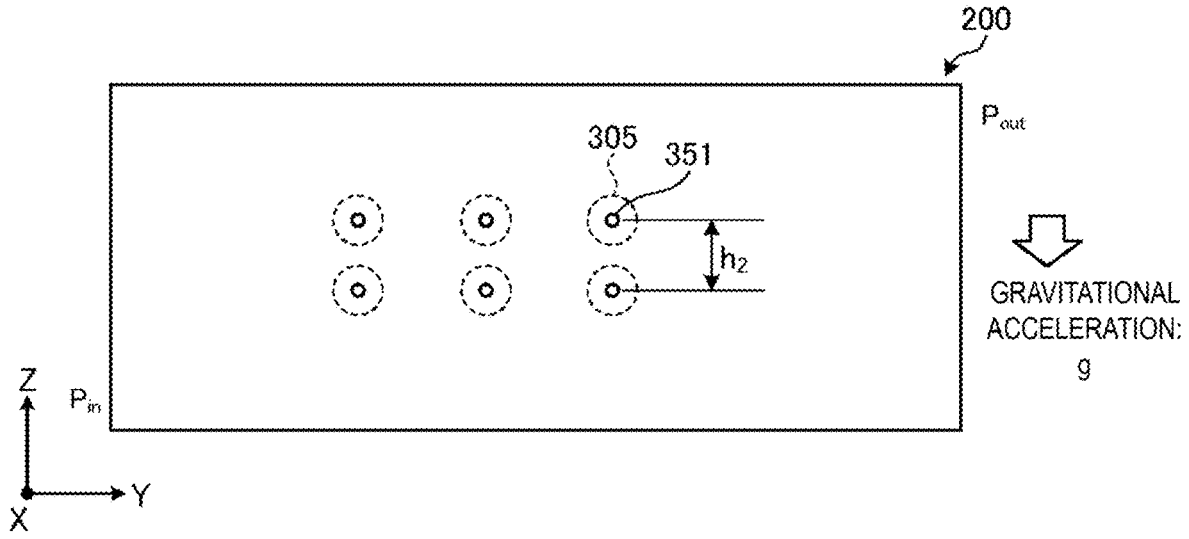
FIG. 11 is a diagram schematically illustrating a positional relationship of discharge holes according to an embodiment.

When the circulation control mode is set to the mode 2, the processor 215 adjusts the supply pressure "$P_{in}$" and the recovery pressure "$P_{out}$" so as to satisfy the control condition of "constant differential pressure". First, the processor 215 calculates the hydraulic head pressure using Equation (1) above. Here, when the circulation control mode is the mode 2, a height "$h_2$" shown in FIG. 11 is used as the "h" in Equation (1) above. As shown in FIG. 11, the height "$h_2$" corresponds to the difference in height between the discharge holes 351 provided in the liquid droplet discharge head 300. The height "$h_2$" is calculated in accordance with the drilling position, based on the design of the liquid droplet discharge head 300, of the discharge hole 351, the posture, based on the detection results of the acceleration sensor 213, of the liquid droplet discharge head 300, and the like. The processor 15 calculates an estimate of the hydraulic head pressure by regarding the physical difference in height between the discharge holes 351 as the height of the water column of the liquid, the physical difference in height being due to a change in the movement and the posture of the liquid droplet discharge head 300.

In the example illustrated in FIG. 9, the effect of a hydraulic head pressure is expected to increase the pressure on an upstream side of the liquid flowing through the supply reservoir 301 and the recovery reservoir 304, and to decrease the pressure on a downstream side thereof. Then, a change in the posture of the liquid droplet discharge head 300 and the like is expected to cause a pressure distribution in the head surface due to the hydraulic head pressure. To satisfy the control condition of "constant differential pressure", the supply pressure "$P_{in}$" is to be decreased and the recovery pressure "$P_{out}$" is to be increased so as to counteract the effect of the hydraulic head pressure. The processor 215 uses Equation (2) above to calculate an adjustment amount of each of the supply pressure "$P_{in}$" and the recovery pressure "$P_{out}$" that satisfies the control condition of "constant differential pressure". The processor 215, while referring to the measurement results of the third pressure sensor 210, decreases the flow rate of the liquid passing through the first proportional valve 204 by narrowing the channel cross-sectional area of the first proportional valve 204 to decrease the supply pressure "$P_{in}$" to a desired pressure based on the adjustment amount. On the other hand, the processor 215, while referring to the measurement results of the fourth pressure sensor 211, increases the flow rate of the liquid passing through the second proportional valve 205 by widening the channel cross-sectional area of the second proportional valve 205 to increase the recovery pressure "$P_{out}$" to a desired pressure based on the adjustment amount.

The processor 215 may set the adjustment amount of each of the supply pressure "$P_{in}$" and the recovery pressure "$P_{out}$" to equal to or less than the estimate of the hydraulic head pressure (ρgh). This allows for stable liquid supply and circulation. Also, the processor 215 may set the adjustment amount of each of the supply pressure "$P_{in}$" and the recovery pressure "$P_{out}$" to equal to or less than half of the estimate of the hydraulic head pressure (ρgh). For example, the adjustment amount of each of the supply pressure "$P_{in}$" and the recovery pressure "$P_{out}$" may be adjusted in the range of "−ρgh/2 to 0" on a high pressure side and in the range of 0 to ρgh/2" on a low pressure side, with the center of the head being "0". For example, when the supply pressure "$P_{in}$" is to be increased, it can be increased only by "ρgh/2", which corresponds to half of the estimate of the hydraulic head pressure, and when the recovery pressure "$P_{out}$" is to be decreased, it can be decreased only by "ρgh/2", which corresponds to half the estimate of the hydraulic head pressure. This may allow for a constant control of the meniscus pressure at the center of the head, stabilizing the circulation of the liquid inside the head.

Figure 12:
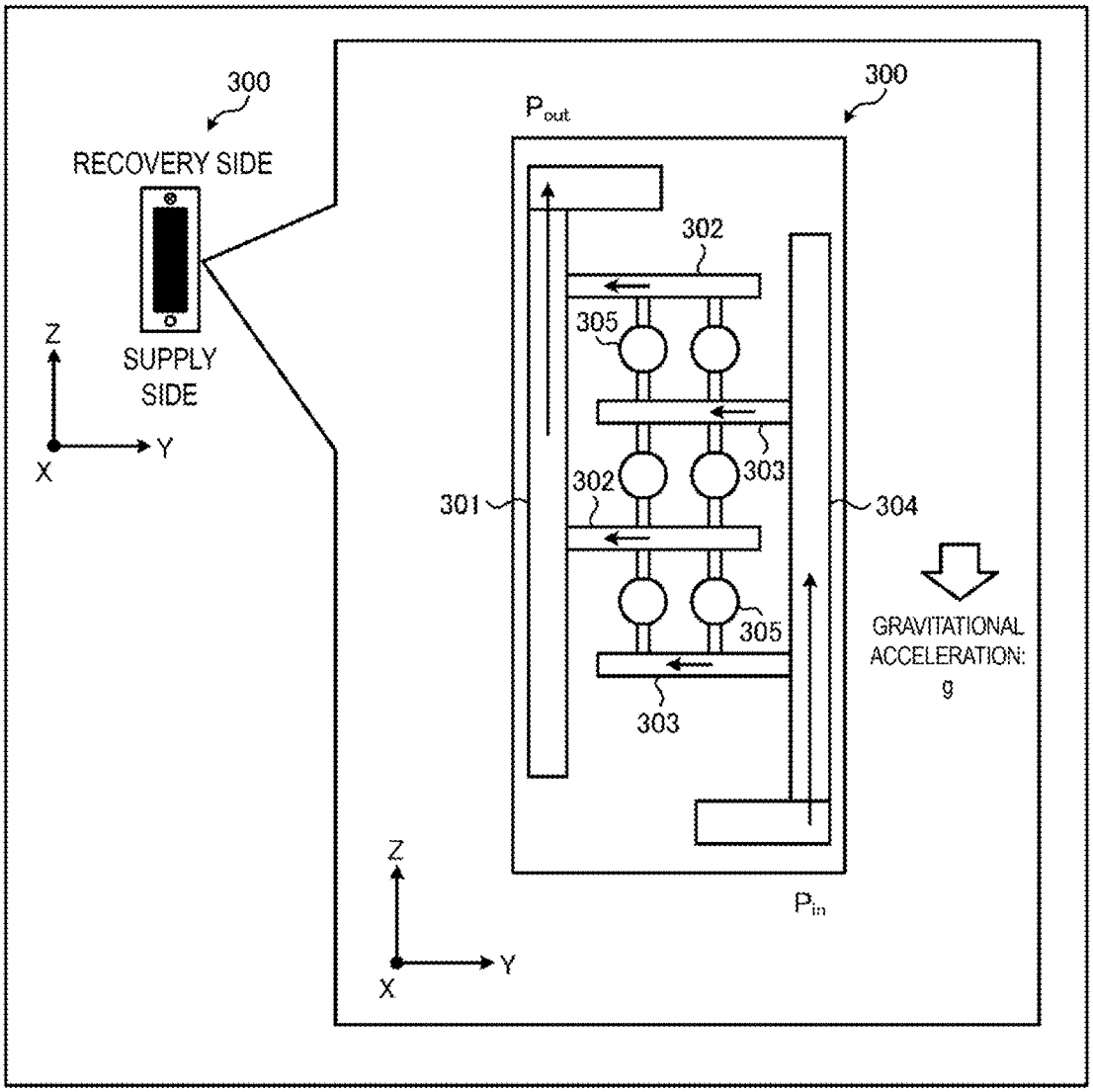
FIG. 12 is a diagram schematically illustrating an example of a posture of a liquid droplet discharge head according to an embodiment.

In addition, the liquid droplet discharge head 300 illustrated in FIG. 12 assumes a posture in which a liquid discharge side faces parallel to the object 50 (see FIG. 1), with the liquid supply side facing a lower side and the liquid recovery side facing an upper side. The posture, illustrated in FIG. 12, of the liquid droplet discharge head 300 corresponds to a posture, illustrated in FIG. 9, in which the liquid droplet discharge head 300 is rotated 90 degrees clockwise. In this case, as illustrated in FIG. 12, the upstream side of the liquid flowing through the supply reservoir 301 and the recovery reservoir 304 is located on a lower side of the circulation direction of the liquid. On the other hand, the downstream side of the liquid flowing through the supply reservoir 301 and the recovery reservoir 304 is located on an upper side of the circulation direction of the liquid. Thus, when the liquid droplet discharge head 300 assumes the posture illustrated in FIG. 11, the effect of the hydraulic head pressure is expected to cause the pressure on the upstream side of the liquid flowing through the supply reservoir 301 and the recovery reservoir 304 to increase and to cause the pressure on the downstream side thereof to decrease.

Figure 13:
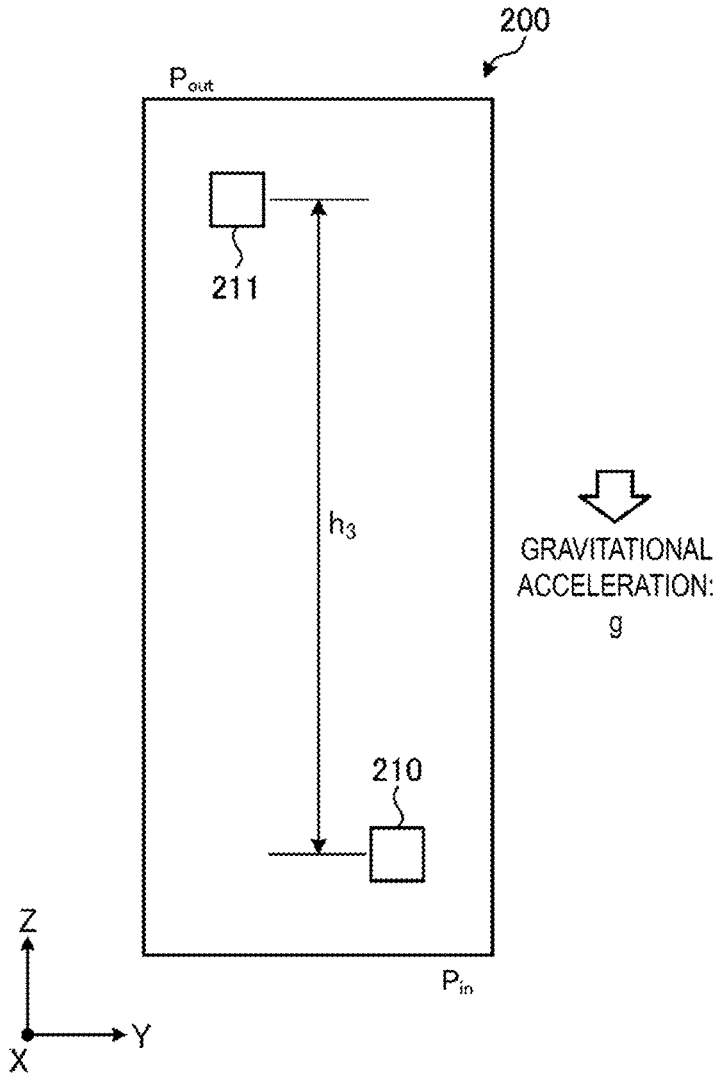
FIG. 13 is a diagram schematically illustrating a positional relationship of pressure sensors according to an embodiment.

Thus, in the case illustrated in FIG. 12, as in the case illustrated in FIG. 9, the processor 215 calculates an estimate of the hydraulic head pressure using Equation (1) above. The liquid droplet discharge head 300 stopped in the posture illustrated in FIG. 12 has only the gravitational acceleration "g" acting thereupon, and the acceleration sensor 213 detects only the gravitational acceleration "g". Thus, the gravitational acceleration "g" is used as the acceleration "a" used in Equation (1) above. In addition, a height "$h_3$" shown in FIG. 13 is used as the height "h" in Equation (1) above. As shown in FIG. 13, the height "$h_3$" corresponds to the difference in height between the position of the third pressure sensor 210 and the position of the fourth pressure sensor 211 in the direction of the gravitational acceleration "g" acting on both the third pressure sensor 210 and the fourth pressure sensor 211. The height "$h_3$" is calculated in accordance with the installation positions, determined on the basis of the design of the liquid droplet discharge head 300, of the third pressure sensor 210 and the fourth pressure sensor 211, and the posture, based on the detection results of the acceleration sensor 213, of the liquid droplet discharge head 300, and the like.

Also, in the case illustrated in FIG. 12, as in the case illustrated in FIG. 9, the processor 215 can adjust the supply pressure and the recovery pressure using Equation (2) above in accordance with the circulation control mode. When the circulation control mode is set to the mode 1, the processor 215 adjusts the supply pressure "$P_{in}$" and the recovery pressure "$P_{out}$" so as to satisfy the control condition of "constant flow rate".

Figure 14:
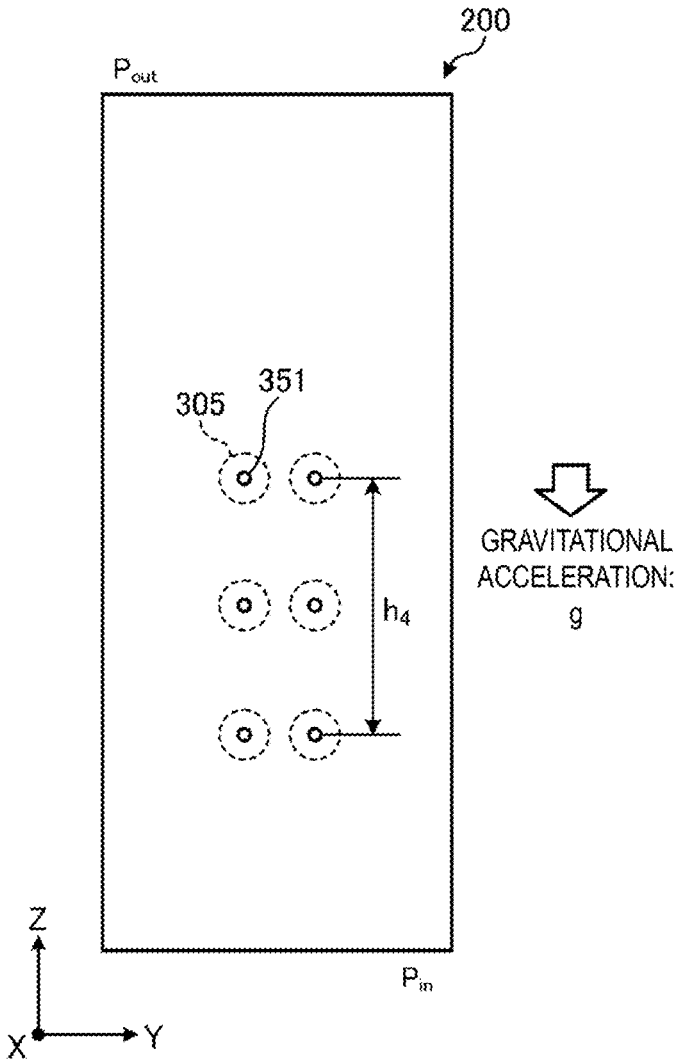
FIG. 14 is a diagram schematically illustrating a positional relationship of discharge holes according to an embodiment.

In addition, when the circulation control mode is set to the mode 2, the processor 215 calculates the hydraulic head pressure using Equation (1) above, and adjusts the supply pressure "$P_{in}$" and the recovery pressure "$P_{out}$" so as to satisfy the control condition of "constant differential pressure". Here, when the processor 215 calculates the hydraulic head pressure, a height "$h_4$" shown in FIG. 14 is used as the height of "h" in Equation (1) above. As shown in FIG. 14, the height "$h_4$" corresponds to the difference in height between the discharge holes 351 provided in the liquid droplet discharge head 300. The height "$h_4$" is calculated in accordance with the drilling position, determined on the basis of the design of the liquid droplet discharge head 300, of the discharge hole 351, the posture, based on the detection results of the acceleration sensor 213, of the liquid droplet discharge head 300, and the like. The processor 15 calculates an estimate of the hydraulic head pressure by regarding the physical difference in height between the discharge holes 351 as the height of the water column of the liquid, the physical difference in height being due to a change in the movement and the posture of the liquid droplet discharge head 300.

Next, with reference to FIGS. 15 to 20, a description will be provided for control in a case where an upstream side of the liquid flowing through the manifold or reservoir is located on an upper side of the circulation direction of the liquid.

Figure 15:
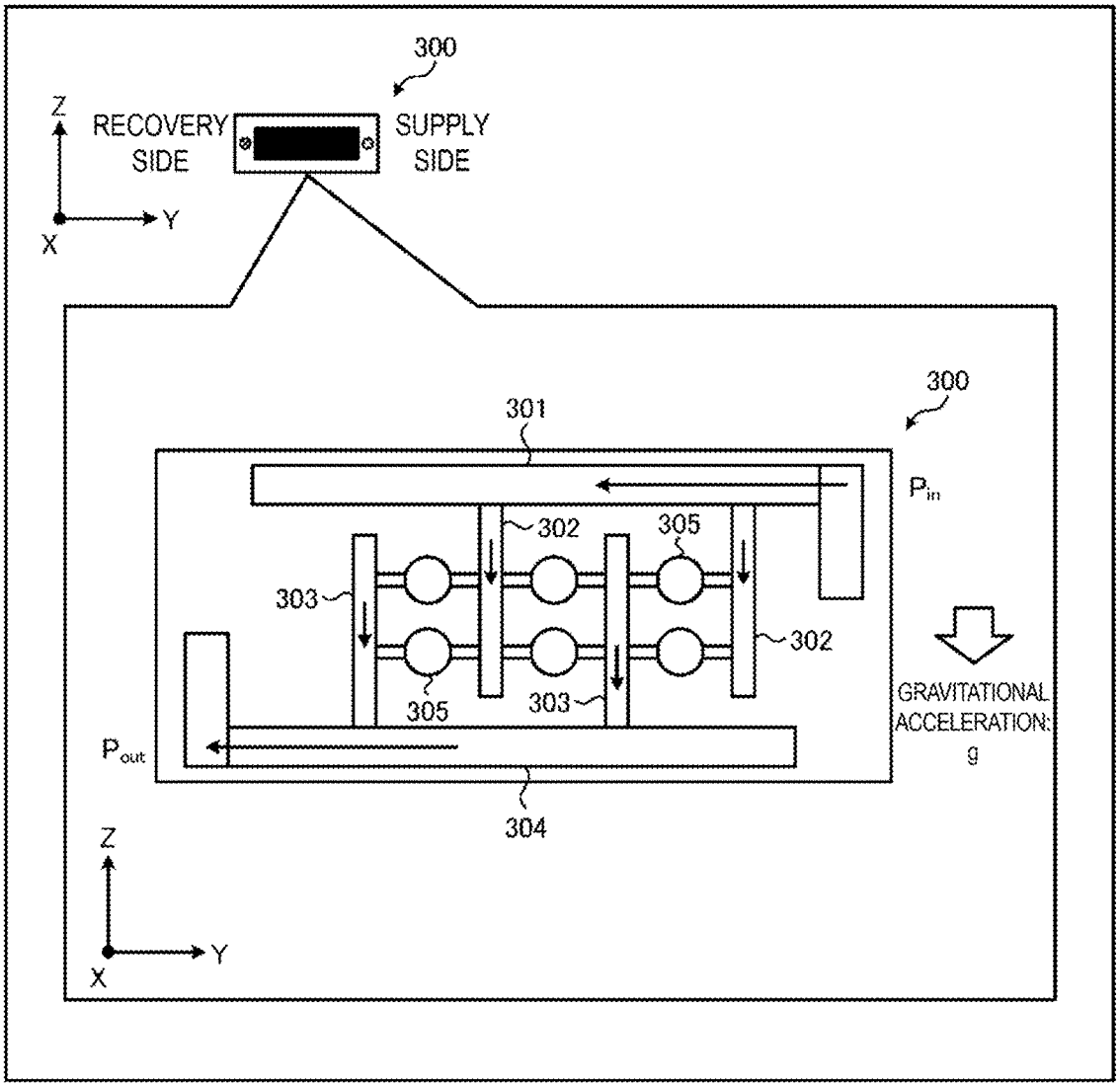
FIG. 15 is a diagram schematically illustrating an example of a posture of a liquid droplet discharge head according to an embodiment.

The liquid droplet discharge head 300 illustrated in FIG. 15 assumes a posture in which the liquid discharge side faces parallel to the object 50 (see FIG. 1), with the liquid supply side facing the right side and the liquid recovery side facing the left side. In this case, as illustrated in FIG. 15, the upstream side of the liquid flowing through the supply manifold 302 and the recovery manifold 303 is positioned on the upper side of the circulation direction of the liquid. On the other hand, the downstream side of the liquid flowing through the supply manifold 302 and the recovery manifold 303 is located on the lower side of the circulation direction of the liquid. Thus, when the liquid droplet discharge head 300 assumes the posture illustrated in FIG. 15, the effect of the hydraulic head pressure is expected to cause the pressure on the upstream side of the liquid flowing through the supply manifold 302 and the recovery manifold 303 to decrease and to cause the pressure on the downstream side thereof to increase.

Thus, the processor 215 calculates, in accordance with the acceleration measured by the acceleration sensor 213, an estimate of the hydraulic head pressure that is expected to be acting on the liquid, illustrated in FIG. 15, that circulates between the tank 201 and the liquid droplet discharge head 300. The processor 215 calculates an estimate of the hydraulic head pressure according to Equation (1) above.

Figure 16:
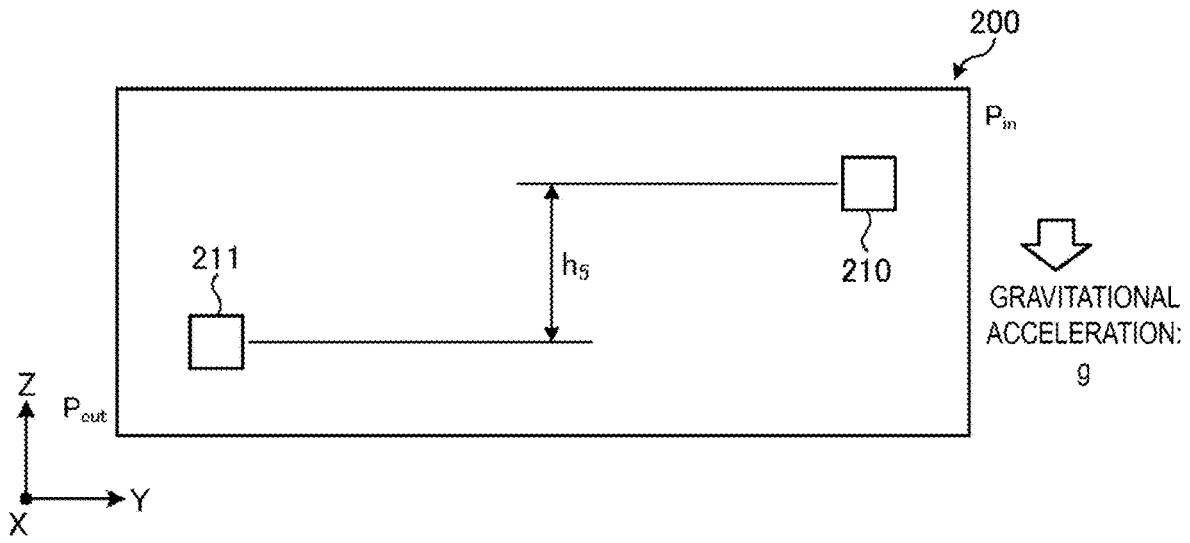
FIG. 16 is a diagram schematically illustrating a positional relationship of pressure sensors according to an embodiment.

The liquid droplet discharge head 300 stopped in the posture illustrated in FIG. 15 has only the gravitational acceleration "g" acting thereupon, and the acceleration sensor 213 detects only the gravitational acceleration "g". Thus, the gravitational acceleration "g" is used as the acceleration "a" used in Equation (1) above. In addition, a height "$h_5$" shown in FIG. 16 is used as the "h" of Equation (1) above. As shown in FIG. 16, the height "$h_5$" corresponds to the difference in height between the position of the third pressure sensor 210 and the position of the fourth pressure sensor 211 in the direction of the gravitational acceleration "g" acting on both the third pressure sensor 210 and the fourth pressure sensor 211. The height "$h_5$" is calculated in accordance with the installation positions, determined on the basis of the design of the liquid droplet discharge head 300, of the third pressure sensor 210 and the fourth pressure sensor 211, and the posture, based on the detection results of the acceleration sensor 213, of the liquid droplet discharge head 300, and the like.

The processor 215 checks the configuration information of the circulation control modes stored in the circulation control mode configuration storage unit 242, and adjusts the supply pressure and the recovery pressure in accordance with the control conditions of the circulation control modes. The processor 215 calculates an adjustment amount of the supply pressure and the recovery pressure that satisfies the control condition of the circulation control mode using Equation (3) below. In Equation (3) below, "ΔP" denotes the differential pressure, which is the difference between the supply pressure and the recovery pressure; "$P_{in}$" denotes the supply pressure; "$P_{out}$" denotes the recovery pressure; "R" denotes the fluid resistance of the liquid; and "U" denotes the flow rate.

$$\Delta P = P_{in} - P_{out} = R \times U - \rho a h \quad (3)$$

When the circulation control mode is set to the mode 1, the processor 215 adjusts the supply pressure "$P_{in}$" and the recovery pressure "$P_{out}$" so as to satisfy the control condition of "constant flow rate". In the example illustrated in FIG. 15, the effect of the hydraulic head pressure is expected to cause the pressure on the upstream side of the liquid flowing through the supply manifold 302 and the recovery manifold 303 to decrease, and to cause the pressure on the downstream side thereof to increase. Then, the circulating flow rate of the liquid circulating inside the head is expected to change due to the hydraulic head pressure acting on the liquid circulating inside the head. To satisfy the control condition of "constant flow rate", the supply pressure "$P_{in}$" is to be decreased and the recovery pressure "$P_{out}$" is to be increased so as to counteract the effect of the hydraulic head pressure. The processor 215 uses Equation (3) above to calculate an adjustment amount of each of the supply pressure "$P_{in}$" and the recovery pressure "$P_{out}$" that satisfies the control condition of "constant flow rate". The processor 215, while referring to the measurement results of the third pressure sensor 210, increases the flow rate of the liquid passing through the first proportional valve 204 by narrowing the channel cross-sectional area of the first proportional valve 204 to decrease the supply pressure "$P_{in}$" to a desired pressure based on the adjustment amount. On the other hand, the processor 215, while referring to the measurement results of the fourth pressure sensor 211, decreases the flow rate of the liquid passing through the second proportional valve 205 by widening the channel cross-sectional area of the second proportional valve 205 to increase the recovery pressure "$P_{out}$" to a desired pressure based on the adjustment amount.

Figure 17:
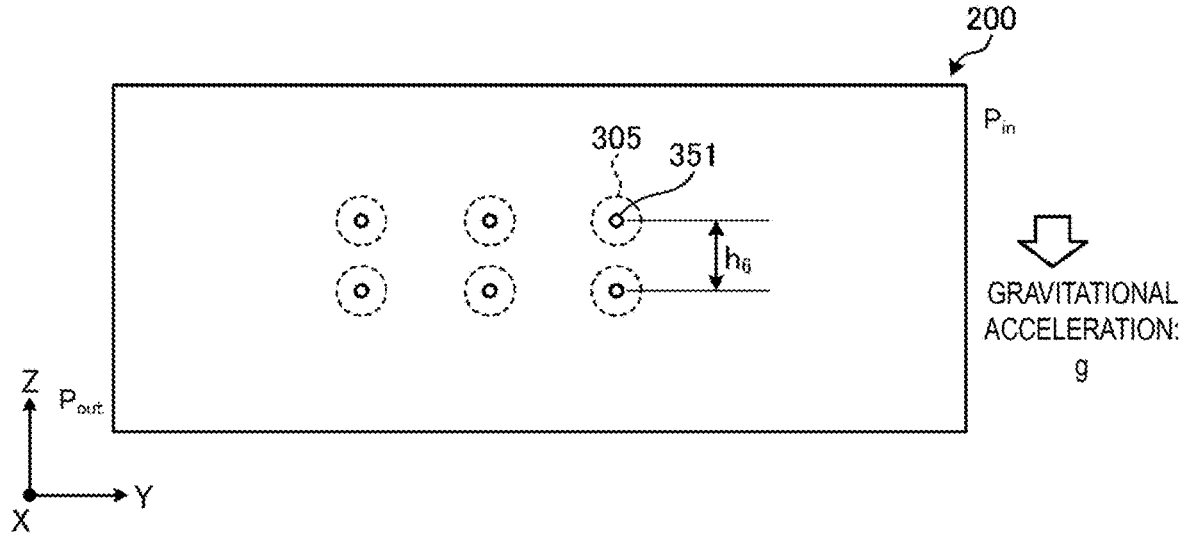
FIG. 17 is a diagram schematically illustrating a positional relationship of discharge holes according to an embodiment.

When the circulation control mode is set to the mode 2, the processor 215 adjusts the supply pressure "$P_{in}$" and the recovery pressure "$P_{out}$" so as to satisfy the control condition of "constant differential pressure". The processor 215 calculates the hydraulic head pressure using Equation (1) above. Here, a height "$h_6$" shown in FIG. 17 is used as the "h" in Equation (1) above. As shown in FIG. 17, the height "$h_6$" corresponds to the difference in height between the discharge holes 351 provided in the liquid droplet discharge head 300. The height "$h_6$" is calculated in accordance with the drilling position, determined on the basis of the design of the liquid droplet discharge head 300, of the discharge hole 351, the posture, based on the detection results of the acceleration sensor 213, of the liquid droplet discharge head 300, and the like. The processor 15 calculates an estimate of the hydraulic head pressure by regarding the physical difference in height between the discharge holes 351 as the height of the water column of the liquid, the physical difference in height being due to a change in the movement and the posture of the liquid droplet discharge head 300.

In the example illustrated in FIG. 15, the effect of the hydraulic head pressure is expected to cause the pressure on the upstream side of the liquid flowing through the supply reservoir 301 and the recovery reservoir 304 to decrease and to cause the pressure on the downstream side thereof to increase. Then, a change in the posture of the liquid droplet discharge head 300 and the like is expected to cause a pressure distribution in the head surface due to the hydraulic head pressure. To satisfy the control condition of "constant differential pressure", the supply pressure "$P_{in}$," is to be increased and the recovery pressure "$P_{out}$" is to be decreased so as to counteract the effect of the hydraulic head pressure. The processor 215 uses Equation (3) above to calculate an adjustment amount of each of the supply pressure "$P_{in}$" and the recovery pressure "$P_{out}$" that satisfies the control condition of "constant differential pressure". The processor 215, while referring to the measurement results of the third pressure sensor 210, increases the flow rate of the liquid passing through the first proportional valve 204 by widening the channel cross-sectional area of the first proportional valve 204 to increase the supply pressure "$P_{in}$" to a desired pressure based on the adjustment amount. On the other hand, the processor 215, while referring to the measurement results of the fourth pressure sensor 211, decreases the flow rate of the liquid passing through the second proportional valve 205 by narrowing the channel cross-sectional area of the second proportional valve 205 to decrease the recovery pressure "$P_{out}$" to a desired pressure based on the adjustment amount.

Figure 18:
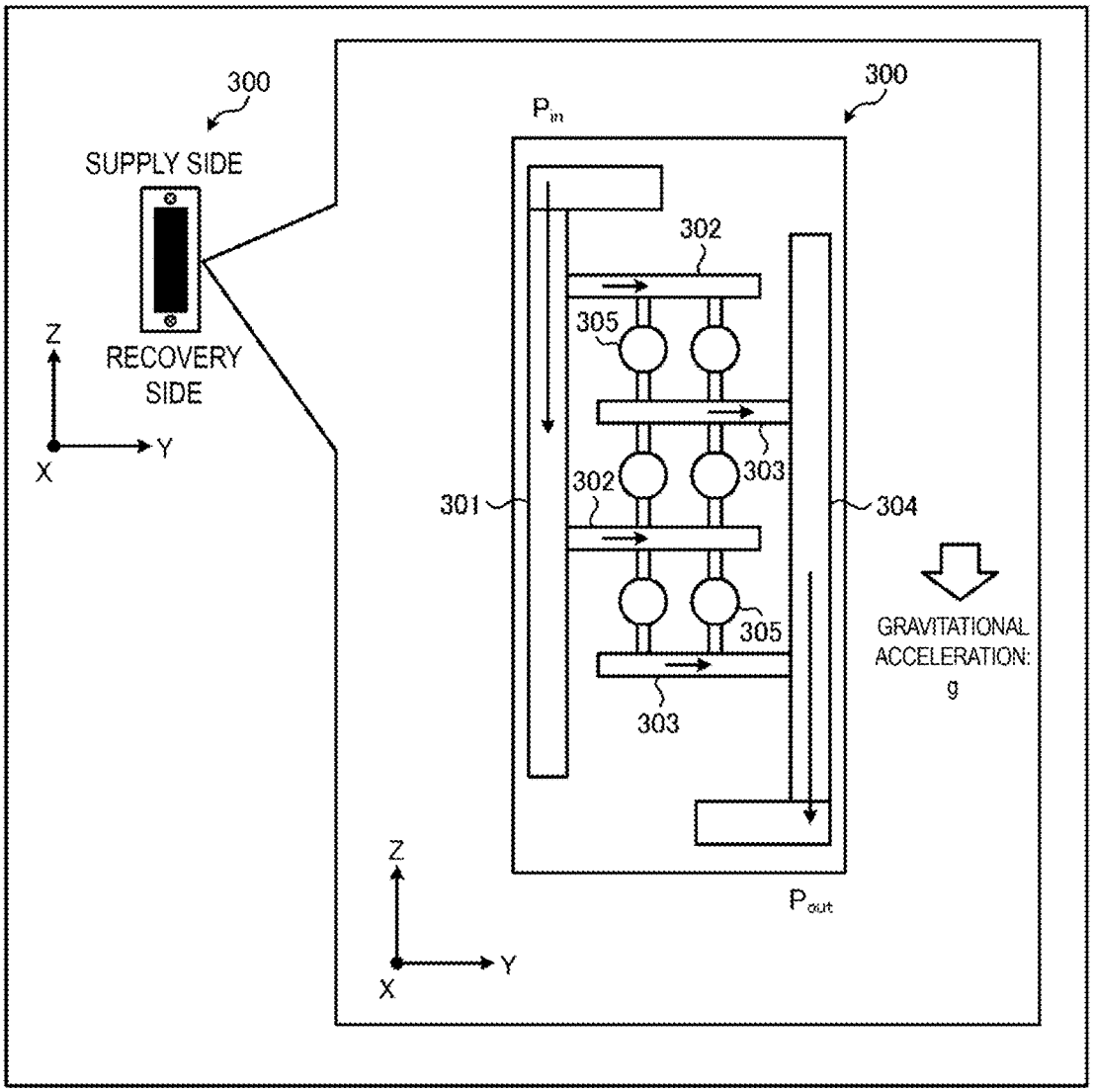
FIG. 18 is a diagram schematically illustrating an example of a posture of a liquid droplet discharge head according to an embodiment.

In addition, the liquid droplet discharge head 300 illustrated in FIG. 18 assumes a posture in which the liquid discharge side faces parallel to the object 50 (see FIG. 1), with the liquid supply side facing the upper side and the liquid recovery side facing the lower side. The posture of the liquid droplet discharge head 300 illustrated in FIG. 18 corresponds to a posture in which the liquid droplet discharge head 300 illustrated in FIG. 15 is rotated 90 degrees clockwise. In this case, as illustrated in FIG. 18, the upstream side of the liquid flowing through the supply reservoir 301 and the recovery reservoir 304 is located on the upper side of the circulation direction of the liquid. On the other hand, the downstream side of the liquid flowing through the supply reservoir 301 and the recovery reservoir 304 is located on the lower side of the circulation direction of the liquid. Thus, when the liquid droplet discharge head 300 assumes the posture illustrated in FIG. 15, the effect of the hydraulic head pressure is expected to cause the pressure on the upstream side of the liquid flowing through the supply reservoir 301 and the recovery reservoir 304 to decrease and to cause the pressure on the downstream side thereof to increase.

Figure 19:
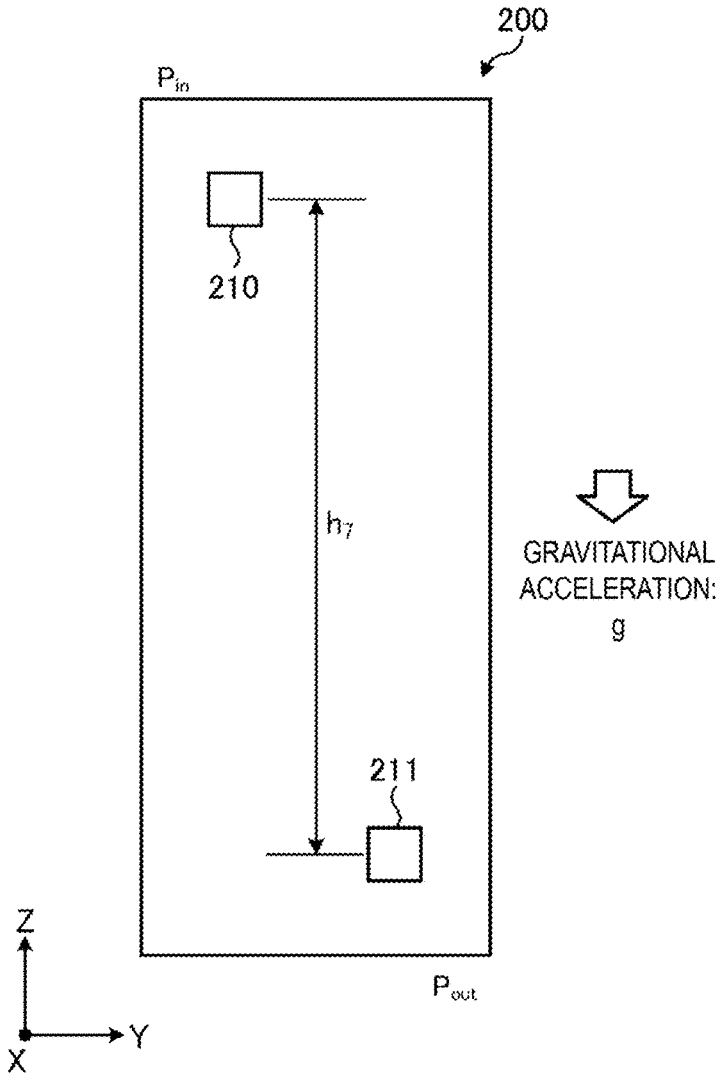
FIG. 19 is a diagram schematically illustrating a positional relationship of pressure sensors according to an embodiment.

Thus, in the case illustrated in FIG. 18, as in the case in FIG. 15, the processor 215 calculates an estimate of the hydraulic head pressure using Equation (1) above. The liquid droplet discharge head 300 stopped in the posture illustrated in FIG. 18 has only the gravitational acceleration "g" acting thereupon, and the acceleration sensor 213 detects only the gravitational acceleration "g". Thus, the gravitational acceleration "g" is used as the acceleration "a" used in Equation (1) above. In addition, a height "$h_7$" shown in FIG. 19 is used as the height "h" in Equation (1) above. As shown in FIG. 19, the height "$h_7$" corresponds to the difference in height between the position of the third pressure sensor 210 and the position of the fourth pressure sensor 211 in the direction of the gravitational acceleration "g" acting on both the third pressure sensor 210 and the position of the fourth pressure sensor 211. The height "$h_7$" is calculated in accordance with the installation positions, determined on the basis of the design of the liquid droplet discharge head 300, of the third pressure sensor 210 and the fourth pressure sensor 211, and the posture, based on the detection results of the acceleration sensor 213, of the liquid droplet discharge head 300, and the like.

Also, as illustrated in FIG. 18, as in the case illustrated in FIG. 15, the processor 215 can adjust the supply pressure and the recovery pressure using Equation (3) above in accordance with the circulation control mode. When the circulation control mode is set to the mode 1, the processor 215 adjusts the supply pressure "$P_{in}$" and the recovery pressure "$P_{out}$" so as to satisfy the control condition of "constant flow rate".

Figure 20:
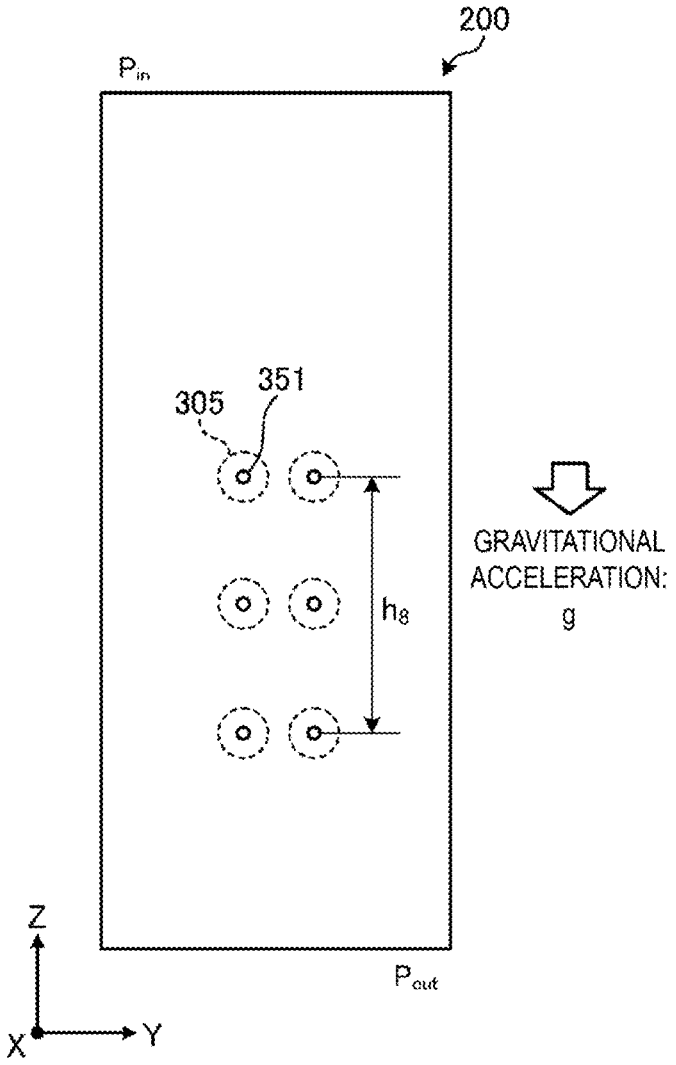
FIG. 20 is a diagram schematically illustrating a positional relationship of discharge holes according to an embodiment.

In addition, when the circulation control mode is set to the mode 2, the processor 215 calculates the hydraulic head pressure using Equation (1) above, and adjusts the supply pressure "$P_{in}$" and the recovery pressure "$P_{out}$" so as to satisfy the control condition of "constant differential pressure". Here, when the processor 215 calculates the hydraulic head pressure, a height "$h_8$" shown in FIG. 20 is used as the height of "h" in Equation (1) above. As shown in FIG. 20, the height "$h_8$" corresponds to the difference in height between the discharge holes 351 provided in the liquid droplet discharge head 300. The height "$h_8$" is calculated in accordance with the drilling position, determined on the basis of the design of the liquid droplet discharge head 300, of the discharge hole 351, the posture, based on the detection results of the acceleration sensor 213, of the liquid droplet discharge head 300, and the like. The processor 15 calculates an estimate of the hydraulic head pressure by regarding the physical difference in height between the discharge holes 351 as the height of the water column of the liquid, the physical difference in height being due to a change in the movement and the posture of the liquid droplet discharge head 300.

Example of Processing Procedure of Circulation Device

Figure 21:
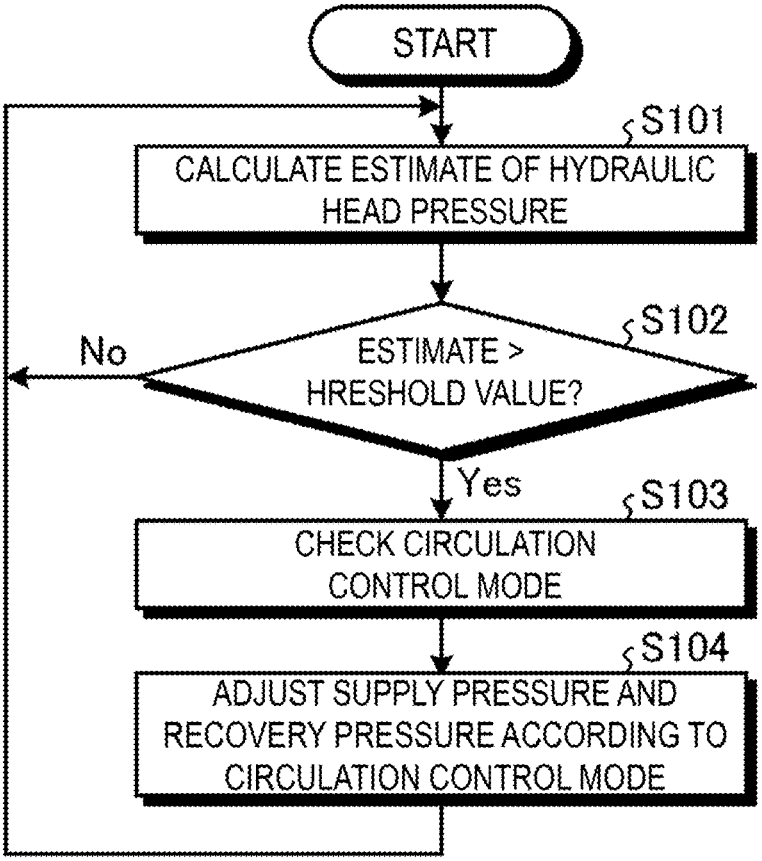
FIG. 21 is a flowchart illustrating an example of a processing procedure of a circulation device according to an embodiment.

An example of a processing procedure of the circulation device 200 according to an embodiment will be described using FIG. 21. FIG. 21 is a flowchart illustrating an example of a processing procedure of a circulation device according to an embodiment. The processing illustrated in FIG. 21 is executed by the processor 215. The processing illustrated in FIG. 21 is repeated during the operation of the circulation device 200.

As illustrated in FIG. 21, the processor 215 calculates an estimate of the hydraulic head pressure (step S101). Then, the processor 215 determines whether the hydraulic head pressure thus calculated is equal to or greater than the threshold value (step S102). In other words, the processor 215 determines whether the hydraulic head pressure occurs to a degree expected to affect the circulation pressure of the liquid circulating through the liquid droplet discharge head 300. Note that the threshold value is preset by an operator of the circulation device 200.

The processor 215, when determining that a calculated estimate of the hydraulic head pressure is equal to or greater than the threshold value (step S102; Yes), checks the circulation control mode (step S103).

Then, the processor 215, in accordance with the circulation control mode, adjusts the supply pressure and the recovery pressure of the liquid circulating between the tank 201 and the liquid droplet discharge head 300 (step S104), and returns to the processing procedure of the step S101.

Also, the processor 215, when determining that a calculated estimate of the hydraulic head pressure is less than the threshold value in the step S102 described above (step S102; No), returns to the processing procedure of the step S101.

Modified Example

A modified example of the circulation device 200 according to an embodiment will be described using FIGS. 22 to 25. FIGS. 22 to 25 are each a diagram schematically illustrating an example of a posture of a liquid droplet discharge head according to a modified example. The liquid droplet discharge head 300 illustrated in FIGS. 22 to 25 differs from the liquid droplet discharge head 300 illustrated in FIGS. 9, 12, 15, and 18 in that the former is moving.

Figure 22:
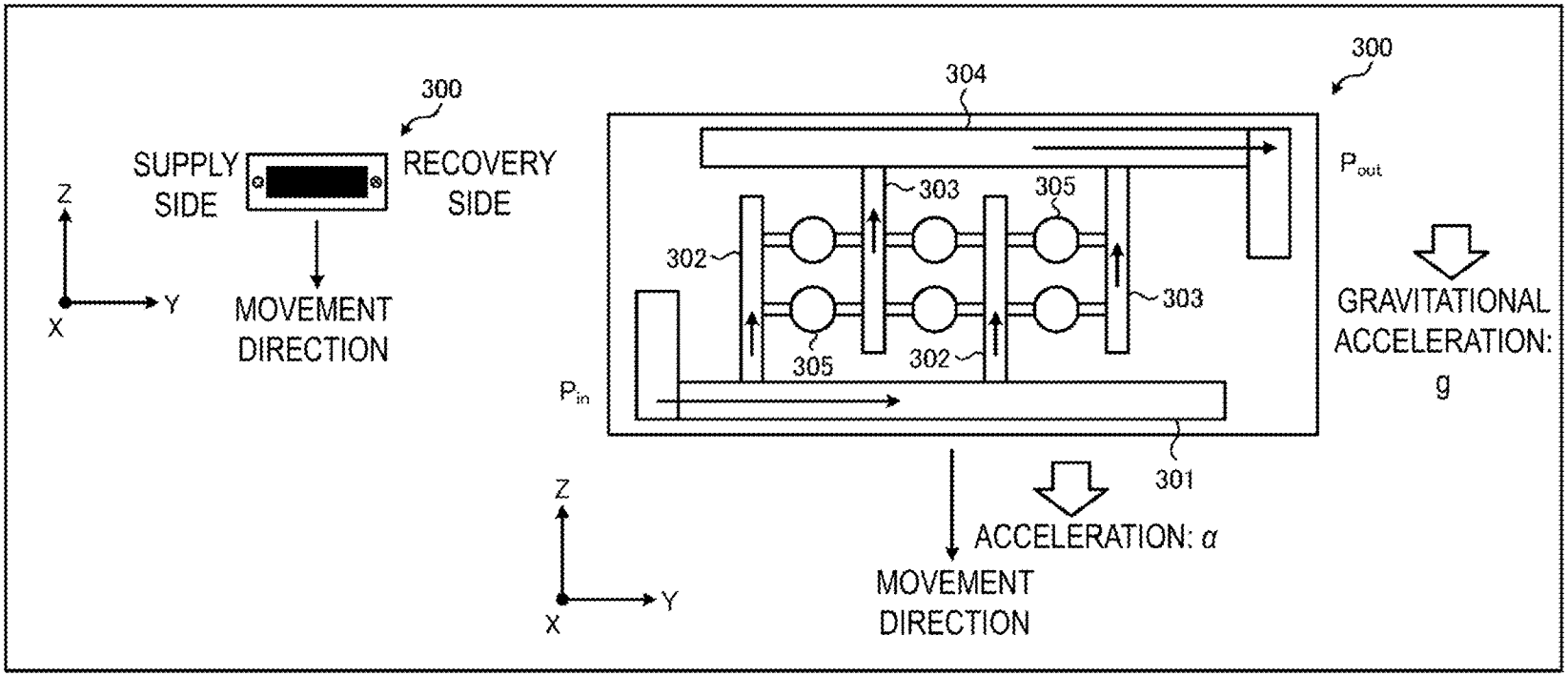
FIG. 22 is a diagram schematically illustrating an example of a posture of a liquid droplet discharge head according to a modified example.

As in the case illustrated in FIG. 9, the liquid droplet discharge head 300 illustrated in FIG. 22 assumes a posture in which the liquid discharge side faces parallel to the object 50 (see FIG. 1), with the liquid supply side facing the left side and the liquid recovery side facing the right side. Furthermore, the liquid droplet discharge head 300 illustrated in FIG. 22 differs from the case illustrated in FIG. 9 in that the former is moving vertically downward (z axis direction), for example, at an acceleration "+α", that is, moving while accelerating at an acceleration "α".

As illustrated in FIG. 22, the liquid circulating through the liquid droplet discharge head 300 is subject not only to the gravitational acceleration "g" but also to the hydraulic head pressure affected by the acceleration "α" of movement of the liquid droplet discharge head 300. Thus, the pressure on the upstream side of the liquid flowing through the supply manifold 302 and the recovery manifold 303 is expected to increase further, and the pressure on the downstream side thereof is expected to decrease further.

Figure 23:
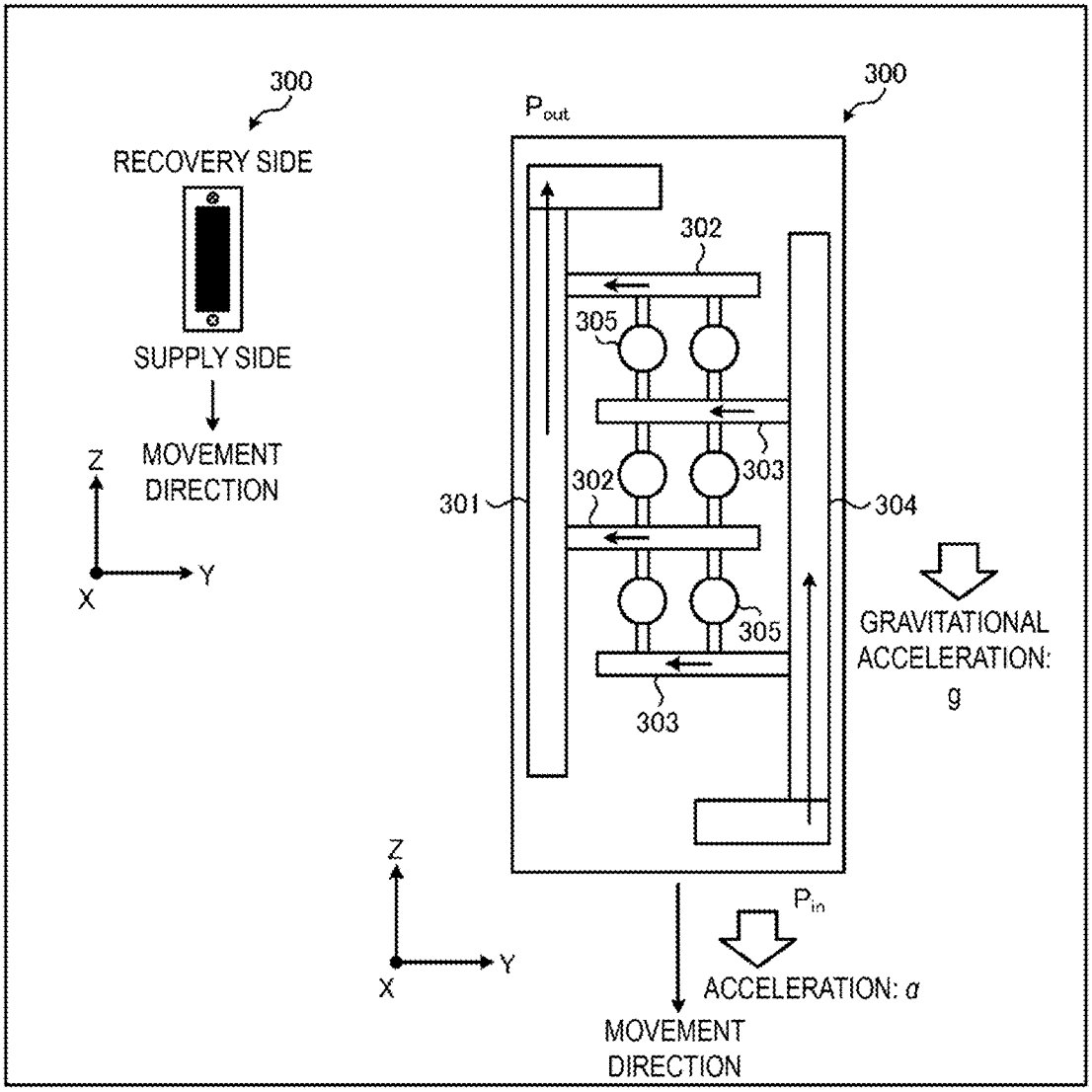
FIG. 23 is a diagram schematically illustrating an example of a posture of a liquid droplet discharge head according to a modified example.

As illustrated in FIG. 12, the liquid droplet discharge head 300 illustrated in FIG. 23 assumes a posture in which the liquid discharge side faces parallel to the object 50 (see FIG. 1), with the liquid supply side facing the lower side and the liquid recovery side facing the upper side. Furthermore, the liquid droplet discharge head 300 illustrated in FIG. 23 differs from the case illustrated in FIG. 12 in that the former is moving vertically downward (z axis direction), for example, at the acceleration "+α", that is, moving while accelerating at the acceleration "α".

As illustrated in FIG. 23, the liquid circulating through the liquid droplet discharge head 300 is subject not only to the gravitational acceleration "g" but also to the hydraulic head pressure affected by the acceleration "α" of movement of the liquid droplet discharge head 300. Thus, the pressure on the upstream side of the liquid flowing through the supply reservoir 301 and the recovery reservoir 304 is expected to increase further, and the pressure on the downstream side thereof is expected to decrease further.

As illustrated in FIGS. 22 and 23, the processor 215 uses Equation (1) above to calculate an estimate of the hydraulic head pressure expected to be acting on the liquid circulating through the liquid droplet discharge head 300. Here, in Equation (1) above, "a" is a combined acceleration of the gravitational acceleration "g" and the acceleration "α" of movement. An acceleration as the liquid droplet discharge head 300 moves is detected by the acceleration sensor 213. Also, when the circulation control mode is the mode 1, the "h" in Equation (1) above is the difference in height between the installation position of the third pressure sensor 210 and the installation position of the fourth pressure sensor 211 in the direction in which the combined acceleration acts. Furthermore, when the circulation control mode is the mode 2, the "h" in Equation (1) above is the difference in height between the discharge holes 351 provided in the liquid droplet discharge head 300.

The processor 215, after calculating an estimate of the hydraulic head pressure, checks the configuration information of the circulation control mode stored in the circulation control mode configuration storage unit 242, and adjusts the supply pressure and the recovery pressure in accordance with the control condition of the circulation control mode, in the same manner as the cases illustrated in FIGS. 9 and 12. The processor 215 can use Equation (2) above to calculate an adjustment amount of each of the supply pressure and the recovery pressure that satisfies the control condition of the circulation control mode.

Figure 24:
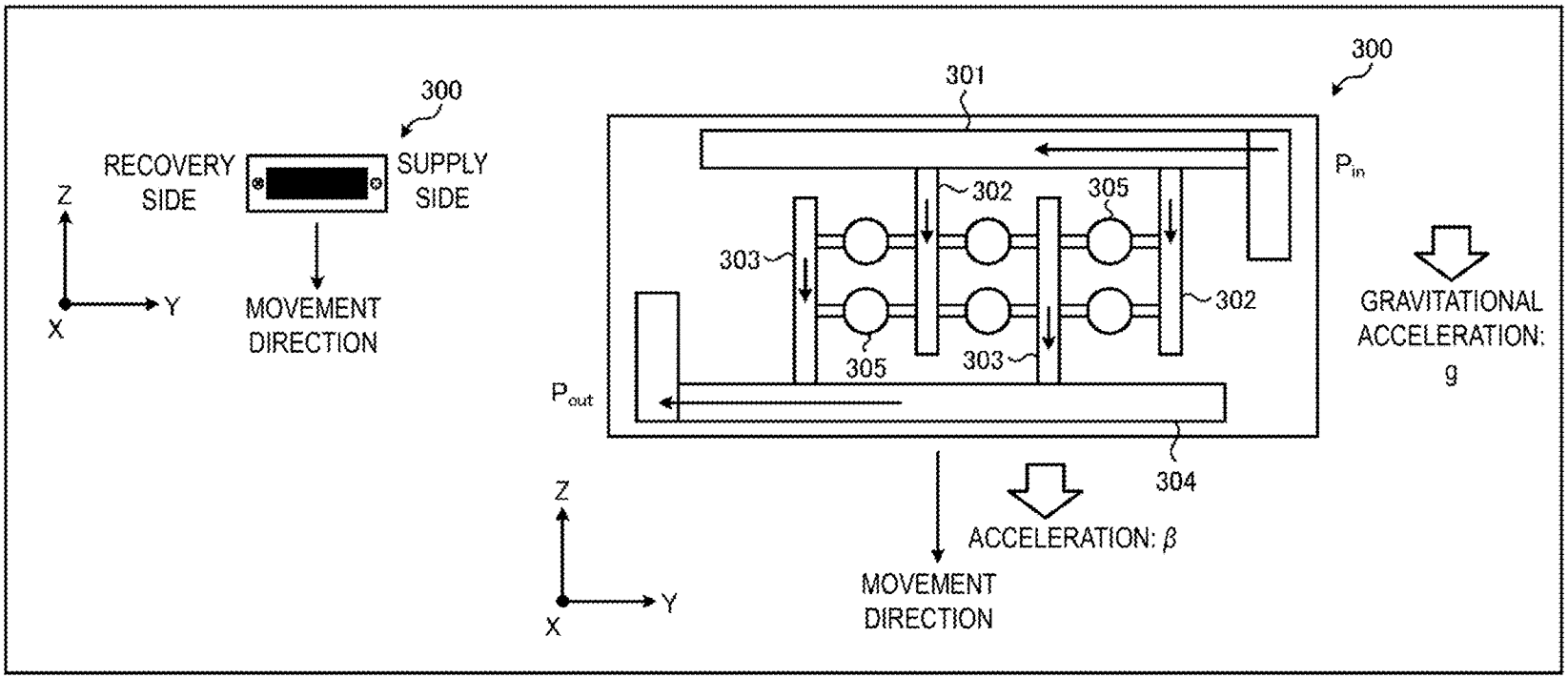
FIG. 24 is a diagram schematically illustrating an example of a posture of a liquid droplet discharge head according to a modified example.

In addition, as in FIG. 15, the liquid droplet discharge head 300 illustrated in FIG. 24 assumes a posture in which the liquid discharge side faces parallel to the object 50 (see FIG. 1), with the liquid supply side facing the right side and the liquid recovery side facing the left side. Furthermore, the liquid droplet discharge head 300 illustrated in FIG. 24 differs from the case illustrated in FIG. 15 in that the former is moving vertically downward (z axis direction), for example, at an acceleration "+β", that is, moving while accelerating at an acceleration "β".

As illustrated in FIG. 24, the liquid circulating through the liquid droplet discharge head 300 is subject not only to the gravitational acceleration "g" but also to the hydraulic head pressure affected by the acceleration "β" of movement of the liquid droplet discharge head 300. Thus, the pressure on the upstream side of the liquid flowing through the supply manifold 302 and the recovery manifold 303 is expected to decrease further, and the pressure on the downstream side thereof is expected to increase further.

Figure 25:
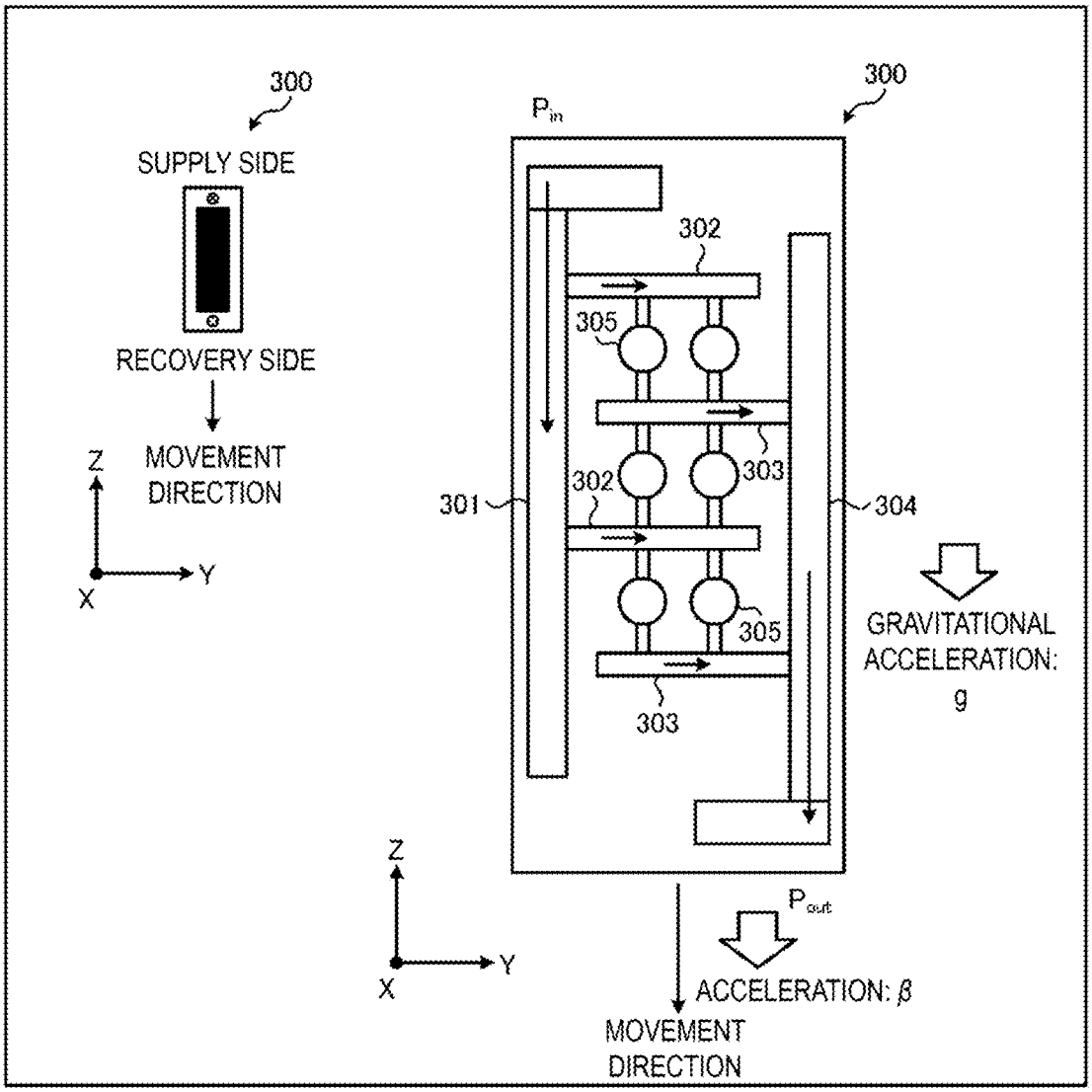
FIG. 25 is a diagram schematically illustrating an example of a posture of a liquid droplet discharge head according to a modified example.

In addition, as in FIG. 18, the liquid droplet discharge head 300 illustrated in FIG. 25 assumes a posture in which the liquid discharge side faces parallel to the object 50 (see FIG. 1), with the supply side facing the upper side and the liquid recovery side facing the lower side. Furthermore, the liquid droplet discharge head 300 illustrated in FIG. 25 differs from the case illustrated in FIG. 15 in that the former is moving vertically downward (z axis direction), for example, at the acceleration "+β", that is, moving while accelerating at the acceleration "β".

As illustrated in FIG. 25, the liquid circulating through the liquid droplet discharge head 300 is subject not only to the gravitational acceleration "g" but also to the hydraulic head pressure affected by the acceleration "β" of movement of the liquid droplet discharge head 300. Thus, the pressure on the upstream side of the liquid flowing through the supply reservoir 301 and the recovery reservoir 304 is expected to decrease further, and the pressure on the downstream side thereof is expected to increase further.

As illustrated in FIGS. 24 and 25, the processor 215 may use Equation (1) above to calculate an estimate of the hydraulic head pressure expected to be acting on the liquid circulating through the liquid droplet discharge head 300. Here, in Equation (1) above, "a" is a combined acceleration of the gravitational acceleration "g" and the acceleration "β" of movement. An acceleration as the liquid droplet discharge head 300 moves is detected by the acceleration sensor 213. Also, when the circulation control mode is the mode 1, the "h" in Equation (1) above is the difference in height between the installation position of the third pressure sensor 210 and the installation position of the fourth pressure sensor 211 in the direction in which the combined acceleration acts. Furthermore, when the circulation control mode is the mode 2, the "h" in Equation (1) above is the difference in height between the discharge holes 351 provided in the liquid droplet discharge head 300.

The processor 215, after calculating an estimate of the hydraulic head pressure, checks the configuration information of the circulation control mode stored in the circulation control mode configuration storage unit 242, and adjusts the supply pressure and the recovery pressure in accordance with the control condition of the circulation control mode, in the same manner as the cases illustrated in FIGS. 15 and 18. The processor 215 can use Equation (3) above to calculate an adjustment amount of each of the supply pressure and the recovery pressure that satisfies the control condition of the circulation control mode.

Furthermore, when the liquid droplet discharge head 300 illustrated in FIG. 22 moves vertically downward while decelerating, such a movement causes a vertical upward acceleration, which is against the gravitational acceleration "g", to act upon the liquid circulating through the liquid droplet discharge head 300. Thus, the magnitude of the pressure on the upstream side of the liquid flowing through the supply manifold 302 and the recovery manifold 303 and that of the pressure on the downstream side thereof are determined by the magnitude correlation between the acceleration of movement acting on the liquid droplet discharge head 300 and the gravitational acceleration "g". For example, the larger the acceleration of movement, the smaller the effect of the hydraulic head pressure on the pressure on the upstream side of the liquid flowing through the supply manifold 302 and the recovery manifold 303 as well as on the pressure on the downstream side thereof. The same applies to the case where the liquid droplet discharge head 300 illustrated in FIG. 23 moves vertically downward while decelerating.

Furthermore, when the liquid droplet discharge head 300 illustrated in FIG. 24 moves vertically downward while decelerating, such a movement causes a vertical upward acceleration, which is against the gravitational acceleration "g", to act upon the liquid circulating through the liquid droplet discharge head 300. Thus, the magnitude of the pressure on the upstream side of the liquid flowing through the supply manifold 302 and the recovery manifold 303 and that of the pressure on the downstream side thereof are determined by the magnitude correlation between the acceleration of movement acting on the liquid droplet discharge head 300 and the gravitational acceleration "g". For example, the larger the acceleration of movement, the smaller the effect of the hydraulic head pressure on the pressure on the upstream side of the liquid flowing through the supply manifold 302 and the recovery manifold 303 as well as on the pressure on the downstream side thereof. The same applies to the case where the liquid droplet discharge head 300 illustrated in FIG. 25 moves vertically downward while decelerating.

In addition, when the liquid droplet discharge head 300 moves at an equal speed, only the gravitational acceleration "g" acts on the liquid circulating through the liquid droplet discharge head 300, and thus the processor 215 calculates an estimate of the hydraulic head pressure in accordance with the gravitational acceleration "g".

Note that in the above-described embodiments and modified example described above, examples have been described in which the supply pressure and the recovery pressure are adjusted by the control of the first proportional valve 204 and the second proportional valve 205, but the supply pressure and the recovery pressure may be adjusted by the control of the discharge pump 202 and the suction pump 203. For example, the supply pressure may be adjusted by adjusting the positive pressure value applied by the discharge pump 202 to the liquid. The recovery pressure may also be adjusted by adjusting the negative pressure value applied by the suction pump 203 to the liquid.

The processor 215, in accordance with an acceleration detected by the acceleration sensor 213, controls the first proportional valve 204 and the second proportional valve 205, and adjusts the supply pressure as liquid is supplied to the liquid droplet discharge head 300 and the recovery pressure as liquid is recovered from the liquid droplet discharge head 300. For example, the processor 215 can adjust the supply pressure and the recovery pressure of the liquid such that even when the liquid circulating through the liquid droplet discharge head 300 is affected by hydraulic head pressure due to a change in the posture of the liquid droplet discharge head 300, the effect of the hydraulic head pressure can be canceled out. For example, when the circulation control mode is the mode 1, the supply pressure and the recovery pressure of the liquid are adjusted such that the flow rate is constant to compensate for insufficient supply of liquid due to a change in the posture and the like of the liquid droplet discharge head 300. In addition, when the circulation control mode is the mode 2, the pressure distribution generated in the head due to a change in the posture and the like of the liquid droplet discharge head 300 is reduced, and the supply pressure and the recovery pressure of the liquid are adjusted such that the differential pressure is constant to maintain the retention performance of the meniscus. Thus, the circulation device 200 according to the embodiment can keep the circulation pressure appropriate even when the circulation pressure of the liquid circulating through the liquid droplet discharge head 300 is affected by a change such as the movement of the liquid droplet discharge head 300, the position, posture, and angle of the liquid droplet discharge head 300, and the like.

In the above-described embodiments and modified example, the circulation device 200 may include the liquid droplet discharge head 300. Additionally, the circulation device 200 may be included in the liquid droplet discharge head 300.

Embodiments have been described in order to fully and clearly disclose the technology according to the appended claims. However, the appended claims are not to be limited to the embodiments described above, and should be configured to embody all modified examples and alternative configurations that a person skilled in the art may make within the fundamental matter set forth in the present description.

The invention claimed is:

1. A circulation device for controlling circulation pressure of a liquid between a storage unit and a liquid droplet discharge unit, the circulation device comprising:

a storage unit configured to store a liquid to be supplied to a liquid droplet discharge unit;

a first channel configured to communicate the storage unit and the liquid droplet discharge unit with each other to allow the liquid stored in the storage unit to flow into the liquid droplet discharge unit;

a second channel configured to communicate the storage unit and the liquid droplet discharge unit with each other to allow the liquid that has flowed into the liquid droplet discharge unit to return to the storage unit;

a first valve portion interposed in the first channel and configured to control a flow rate of the liquid fed from the storage unit to the liquid droplet discharge unit;

a second valve portion interposed in the second channel and configured to control a flow rate of the liquid fed from the liquid droplet discharge unit to the storage unit;

a first pressure measuring portion configured to measure, through the first channel, a fluid pressure of the liquid flowing between the first valve portion and the liquid droplet discharge unit as a supply pressure;

a second pressure measuring portion configured to measure, through the second channel, a fluid pressure of the liquid flowing between the second valve portion and the liquid droplet discharge unit as a recovery pressure;

a detection unit configured to detect information related to the liquid droplet discharge unit; and a controller configured to control the first valve portion and the second valve portion in accordance with the information detected by the detection unit and to adjust the supply pressure and the recovery pressure.

2. The circulation device according to claim 1, wherein the detection unit detects an acceleration acting on the liquid droplet discharge unit, and the controller calculates an estimate of a hydraulic head pressure acting on the liquid in accordance with a density of the liquid, an acceleration acting on the liquid, and a difference in height between the first pressure measuring portion and the second pressure measuring portion, the difference in height corresponding to a direction of the acceleration acting on the liquid; and adjusts the supply pressure and the recovery pressure in accordance with the estimate of the hydraulic head pressure to keep constant the flow rate of the liquid, the flow rate changing due to the hydraulic head pressure.

3. The circulation device according to claim 2, wherein an adjustment amount of the difference between the supply pressure and the recovery pressure is smaller than the hydraulic head pressure.

4. The circulation device according to claim 2, wherein an adjustment amount of the difference between the supply pressure and the recovery pressure is half of the hydraulic head pressure.

5. The circulation device according to claim 1, wherein the detection unit detects an acceleration acting on the liquid droplet discharge unit, and the controller calculates an estimate of a hydraulic head pressure acting on the liquid in accordance with a density of the liquid, an acceleration acting on the liquid, and a difference in height between the first pressure measuring portion and the second pressure measuring portion, the difference in height corresponding to a direction of the acceleration acting on the liquid; and adjusts the supply pressure and the recovery pressure to keep constant a difference between the supply pressure and the recovery pressure, the difference changing due to the hydraulic head pressure.

6. The circulation device according to claim 5, wherein an adjustment amount of the difference between the supply pressure and the recovery pressure is smaller than the hydraulic head pressure.

7. The circulation device according to claim 5, wherein an adjustment amount of the difference between the supply pressure and the recovery pressure is half of the hydraulic head pressure.

8. The circulation device according to claim 1, wherein the controller is further configured to control the circulation pressure to mitigate a hydraulic head pressure based on position information of the liquid droplet discharge unit, the position information being detected by the detection unit.

9. The circulation device according to claim 8, wherein the detection unit detects an inclination of the liquid droplet discharge unit, and the controller controls the circulation pressure to mitigate the hydraulic head pressure due to the inclination of the liquid droplet discharge unit.

10. A circulation device, comprising:

a storage unit configured to store a liquid to be supplied to a liquid droplet discharge unit;

a first channel configured to communicate the storage unit and the liquid droplet discharge unit with each other to allow the liquid stored in the storage unit to flow into the liquid droplet discharge unit;

a second channel configured to communicate the storage unit and the liquid droplet discharge unit with each other to allow the liquid that has flowed into the liquid droplet discharge unit to return to the storage unit;

a detection unit configured to detect information related to the liquid droplet discharge unit; and a controller configured to control a circulation pressure of the liquid circulating between the storage unit and the liquid droplet discharge unit; and the controller being configured to control the circulation pressure to mitigate a hydraulic head pressure based on acceleration information of the liquid droplet discharge unit, the acceleration information being detected by the detection unit.

* * * * *